US008693903B2

(12) United States Patent
Ikeda

(10) Patent No.: US 8,693,903 B2
(45) Date of Patent: Apr. 8, 2014

(54) IMAGE FORMING APPARATUS

(75) Inventor: Yuichi Ikeda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 128 days.

(21) Appl. No.: 13/197,129

(22) Filed: Aug. 3, 2011

(65) Prior Publication Data

US 2012/0033984 A1 Feb. 9, 2012

(30) Foreign Application Priority Data

Aug. 5, 2010 (JP) ..... 2010-176251

(51) Int. Cl.
*G03G 15/02* (2006.01)

(52) U.S. Cl.
USPC ..... 399/50

(58) Field of Classification Search
USPC ..... 399/50, 89, 37
See application file for complete search history.

(56) References Cited

U.S. PATENT DOCUMENTS

| | | | | |
|---|---|---|---|---|
| 5,426,488 | A * | 6/1995 | Hayakawa et al. | 399/174 |
| 6,498,908 | B2 * | 12/2002 | Phillips et al. | 399/48 |
| 6,532,347 | B2 | 3/2003 | Watanabe et al. | |
| 6,640,063 | B2 * | 10/2003 | Adachi et al. | 399/50 |
| 6,996,356 | B2 * | 2/2006 | Atsumi | 399/129 |
| 7,031,628 | B2 * | 4/2006 | Sekovski et al. | 399/50 |
| 7,395,011 | B2 * | 7/2008 | Tanaka | 399/128 |
| 2001/0019669 | A1 | 9/2001 | Watanabe et al. | |
| 2008/0131155 | A1 * | 6/2008 | Kobashi et al. | 399/50 |
| 2010/0111556 | A1 * | 5/2010 | Shibuya et al. | 399/71 |

FOREIGN PATENT DOCUMENTS

| | | | |
|---|---|---|---|
| JP | 06-011952 | A | 1/1994 |
| JP | 08-272194 | A | 10/1996 |
| JP | 2001-201920 | A | 7/2001 |
| JP | 2001-201921 | A | 7/2001 |

* cited by examiner

*Primary Examiner* — Clayton E LaBalle
*Assistant Examiner* — Victor Verbitsky
(74) *Attorney, Agent, or Firm* — Fitzpatrick, Cella, Harper & Scinto

(57) ABSTRACT

An image forming apparatus includes an image bearing member; a first charging member for electrically charging the image bearing member by being supplied with an oscillating voltage in the form of a DC voltage biased with a common AC voltage during image formation; a second charging member, provided downstream of the first charging member with respect to a movement direction of the image bearing member, for electrically charging the image bearing member by being supplied with the DC voltage and the common AC voltage during the image formation; detecting portion for detecting an AC current passing through the second charging member; and a setting portion for setting, on the basis of a detection result of the detecting portion when a predetermined AC voltage is applied to the second charging member during non-image formation, the common AC voltage applied to the first charging member and the second charging member during the image formation so that a discharge current between the second charging member and the image bearing member is a predetermined value.

3 Claims, 19 Drawing Sheets

IMAGE FORMING APPARATUS

FIELD OF THE INVENTION AND RELATED ART

The present invention relates to an image forming apparatus in which an image bearing member is electrically charged by applying to a plurality of charging members an oscillating voltage in the form of a DC voltage biased (superposed) with an AC voltage.

In a charging step of an electrophotographic type, a contact AC charging type in which an AC voltage is applied between the image bearing member and a charging member contacted to the image bearing member is employed. In the contact AC charging type, the image bearing member can be uniformly charged by an occurrence of DC voltage electric discharge between the image bearing member and the charging member.

Here, in the case where the AC voltage is applied to the charging member, there is a need to properly set the AC voltage. This is because charge transfer by the electric discharge becomes insufficient when the AC voltage is excessively low and thus the surface of the image bearing member cannot be charged to the DC voltage. Further, on the other hand, when the AC voltage is excessively high, the electric discharge occurs excessively to damage of the image bearing member or a generation amount of an electric discharge product is increased and thus image defect such as image flow (image deletion) is caused.

However, depending on a consumption state of the image bearing member, a temperature and humidity environment and the like, an electric discharge state is different and therefore a proper AC voltage to be applied to the charging member fluctuates. For that reason, when the same constant current (or constant voltage) is applied to the charging member, the AC voltage becomes improper in some cases.

Japanese Laid-Open Patent Application (JP-A) 2001-201921 discloses a constitution in which a plurality of levels of the AC voltage are applied during non-image formation to detect values of the AC current passing through the charging member and then a relational expression between the AC voltage and the AC current is obtained to calculate a proper AC voltage. Specifically, from the relational expression between the AC voltage and the AC current, the constant current of the AC voltage corresponding to an electric discharge current value for permitting charge transfer with no excess and no deficiency is set.

In recent years, in order to enhance productivity of the image forming apparatus, a movement speed (process speed) of the image bearing member is increased, with the result that a time of the charge transfer between the image bearing member and the charging member opposed to the image bearing member is shortened and therefore charging non-uniformity is liable to occur. Here, when the amount of the electric discharge current is increased by increasing a peak-to-peak voltage of the AC voltage, it is possible to perform sufficient charge transfer even in a short opposing time when the image bearing member and the charging member are opposed to each other. However, as described above in this case, a durability lifetime of the image bearing member is impaired and the image defect resulting from the electric discharge product is liable to occur, thus being unpreferable.

Therefore, a constitution in which a plurality of charging members are arranged in series and a common oscillating voltage is applied from a single power source to the charging members and thus the image bearing member is charged to a plurality of levels has been proposed. By this constitution, the image bearing member is charged to the plurality of levels, so that it is possible to ensure the time, of the charge transfer between the opposing image bearing member and charging members, increased by a factor of plural times. Incidentally, it would be considered that the power source is individually provided every charging member. However, there are disadvantages that a cost is increased by an increase in the number of the power sources and that a time required to contact a charge voltage is prolonged depending on the number of the charging members.

Here, when the present inventor prepared a test model for applying a common oscillating voltage to a plurality of charging members and subjected the test model to an experiment, electric discharge non-uniformity could be suppressed to an expected degree, so that a so-called "sandpaper-like" image occurred. The "sandpaper-like" image refers to a charge non-uniformity image which is roughened in a sandpaper-like shape by formation of a particulate drop area of charge potential at the surface of the image bearing member by an insufficient electric discharge current area which reflects a distribution of a surface resistance of the charging roller (charging member).

In order to obviate the "sandpaper-like" image, when the electric discharge current in an amount larger than an assumed amount for the plurality of charging members was set, the amount of the electric discharge product was increased to result in occurrences of "image flow" and "drum abrasion". The "image flow" is disorder of the image caused due to moisture absorption of the electric discharge product deposited on the image bearing member to locally lower the surface resistance. The "drum abrasion" refers to a state in which a texture of a photosensitive layer exposed to high-density electric discharge is weakened and is susceptible to abrasion (wearing) by sliding friction with a cleaning blade.

SUMMARY OF THE INVENTION

A principal object of the present invention is to provide an image forming apparatus capable of suppressing image flow and drum abrasion, without causing an occurrence of a sand paper-like image, by ensuring a electric discharge current with no excess and no deficiency when a common voltage is applied to a plurality of charging members.

According to an aspect of the present invention, there is provided an image forming apparatus, comprising:

an image bearing member;

a first charging member for electrically charging the image bearing member by being supplied with an oscillating voltage in the form of a DC voltage biased with a common AC voltage during image formation;

a second charging member, provided downstream of the first charging member with respect to a movement direction of the image bearing member, for electrically charging the image bearing member by being supplied with the DC voltage and the common AC voltage during the image formation;

detecting means for detecting an AC current passing through the second charging member; and setting means for setting, on the basis of a detection result of the detecting means when a predetermined AC voltage is applied to the second charging member during non-image formation, the common AC voltage applied to the first charging member and the second charging member during the image formation so that a discharge current between the second charging member and the image bearing member is a predetermined value.

These and other objects, features and advantages of the present invention will become more apparent upon a consideration of the following description of the preferred embodiments of the present invention taken in conjunction with the accompanying drawings.

Figure 8:
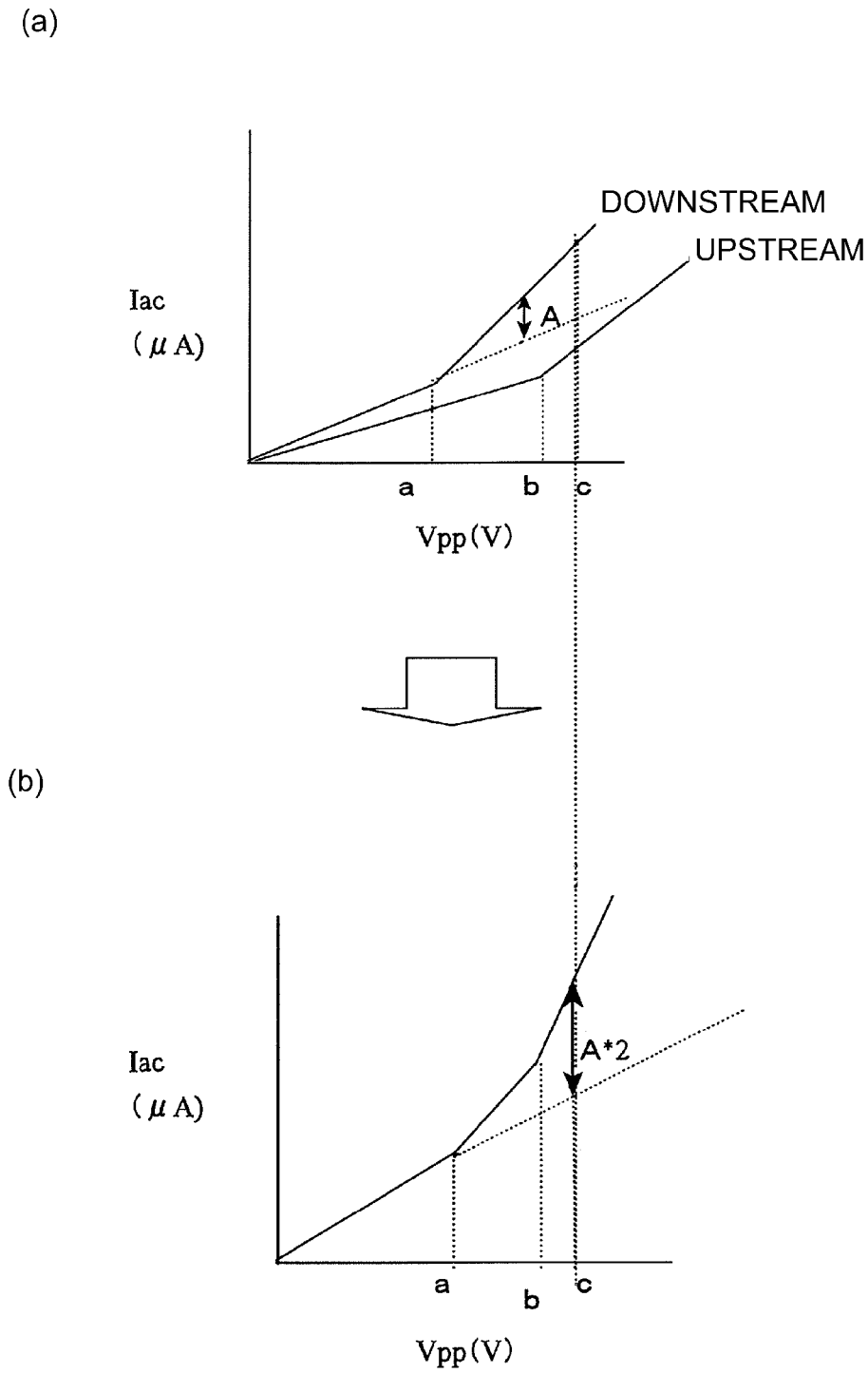

Parts (a) and (b) of FIG. 8 are illustrations of a problem of AC electric discharge current control the case where the two charging rollers are used.

Figure 9:
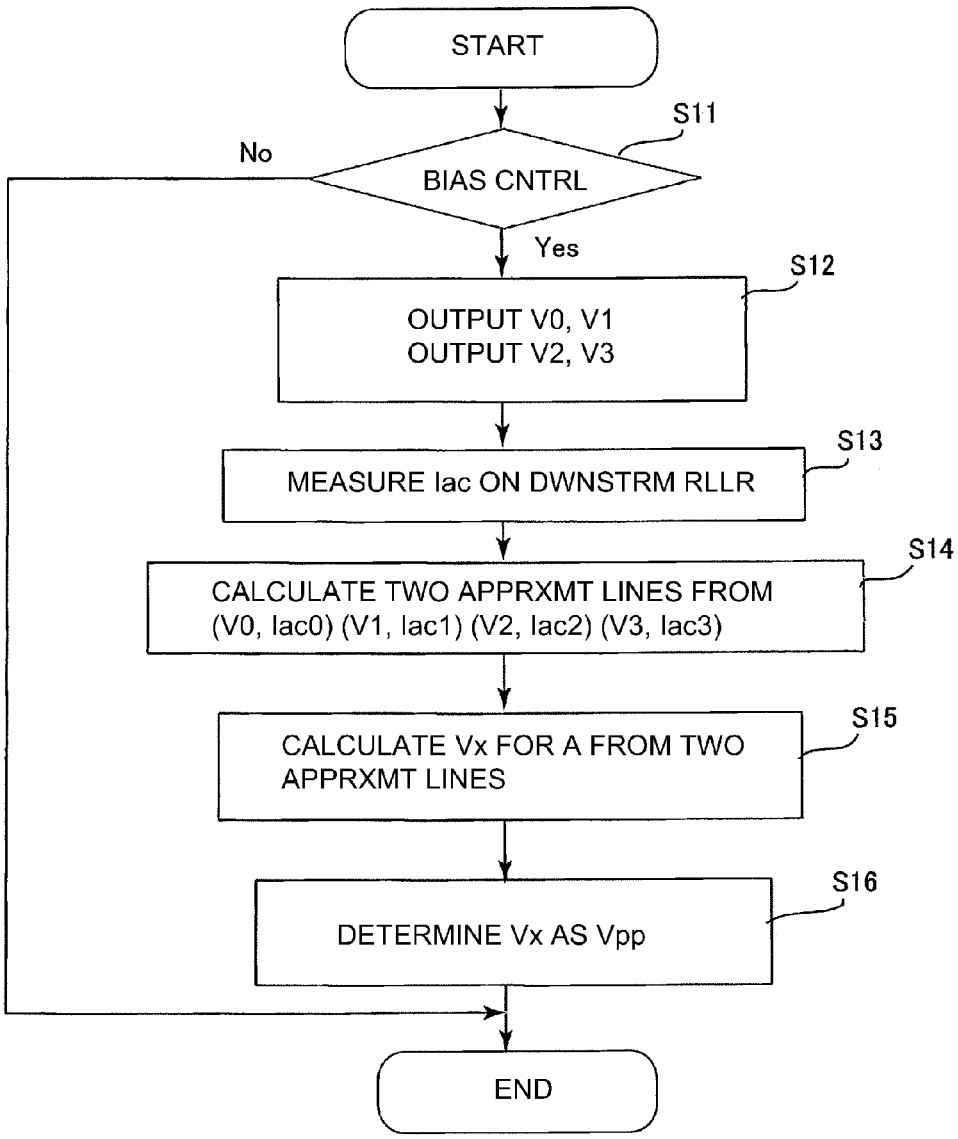

FIG. 9 is a flow chart of AC electric discharge current control in Embodiment 1.

Figure 10:
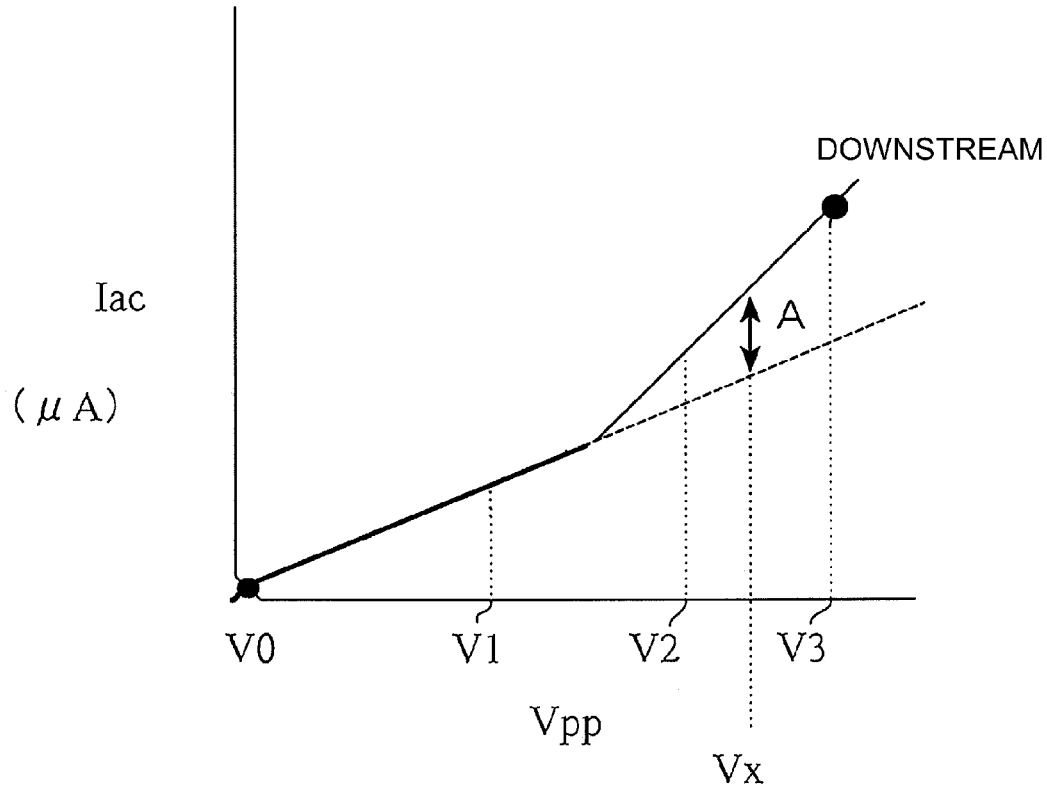

FIG. 10 is a graph showing a relationship between a peak-to-peak voltage and a detected current in Embodiment 1.

Figure 11:
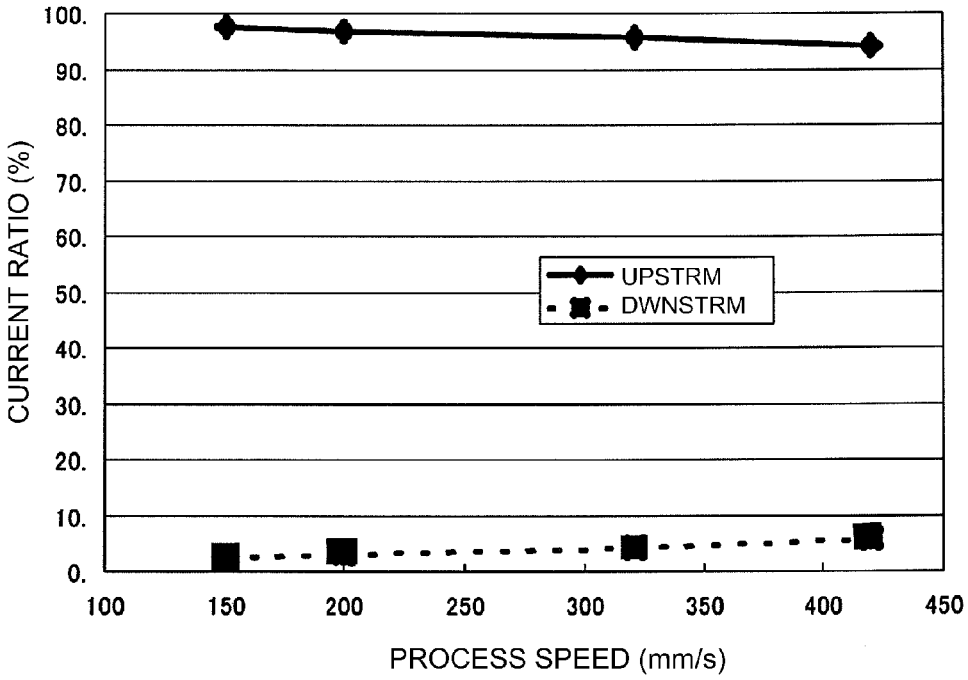

FIG. 11 is an illustration of a DC current distribution of a charging roller in Embodiment 1.

Figure 12:
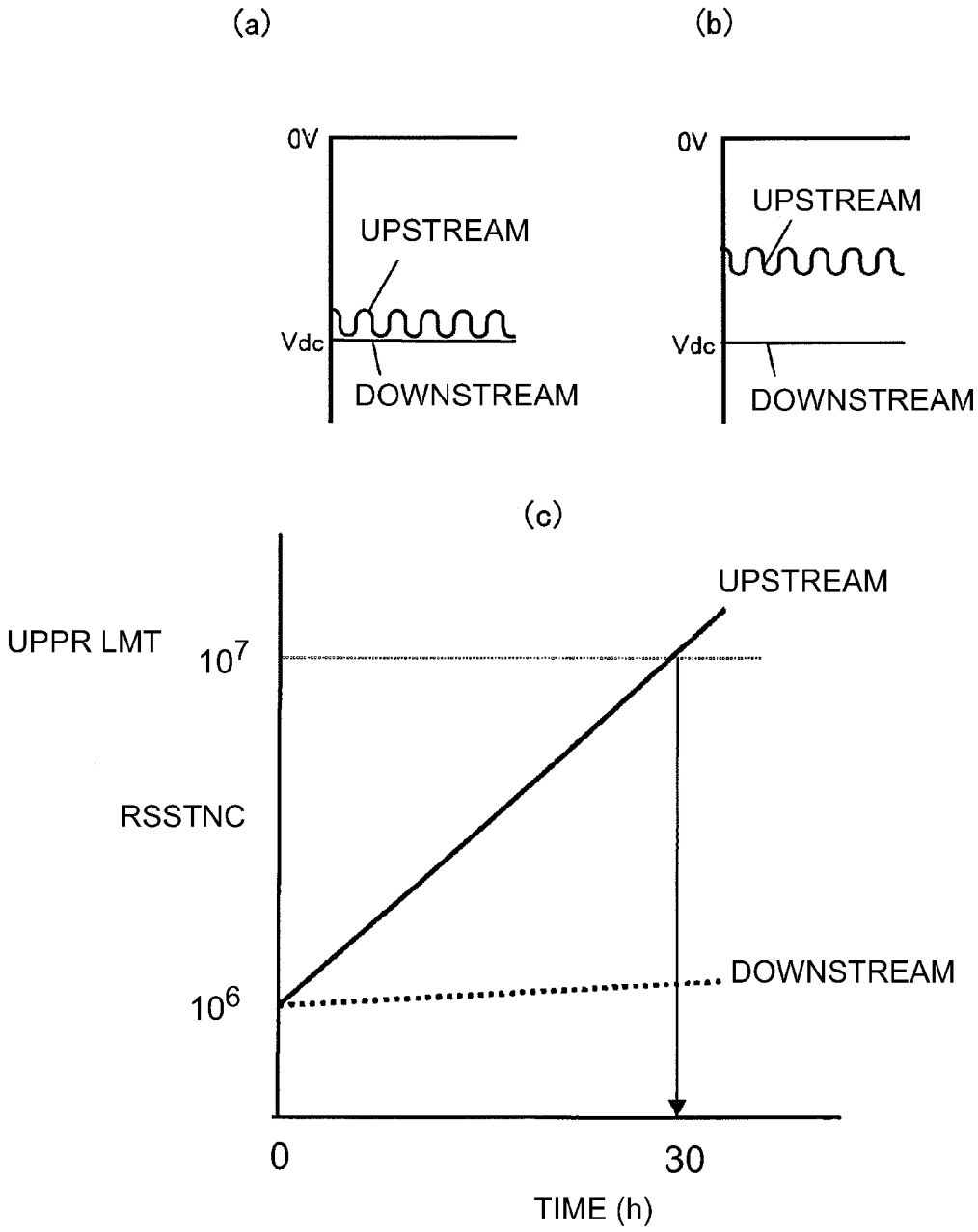

Parts (a), (b) and (c) of FIG. 12 are illustrations of a change with time of a resistance value of the charging roller in Embodiment 1.

Figure 13:
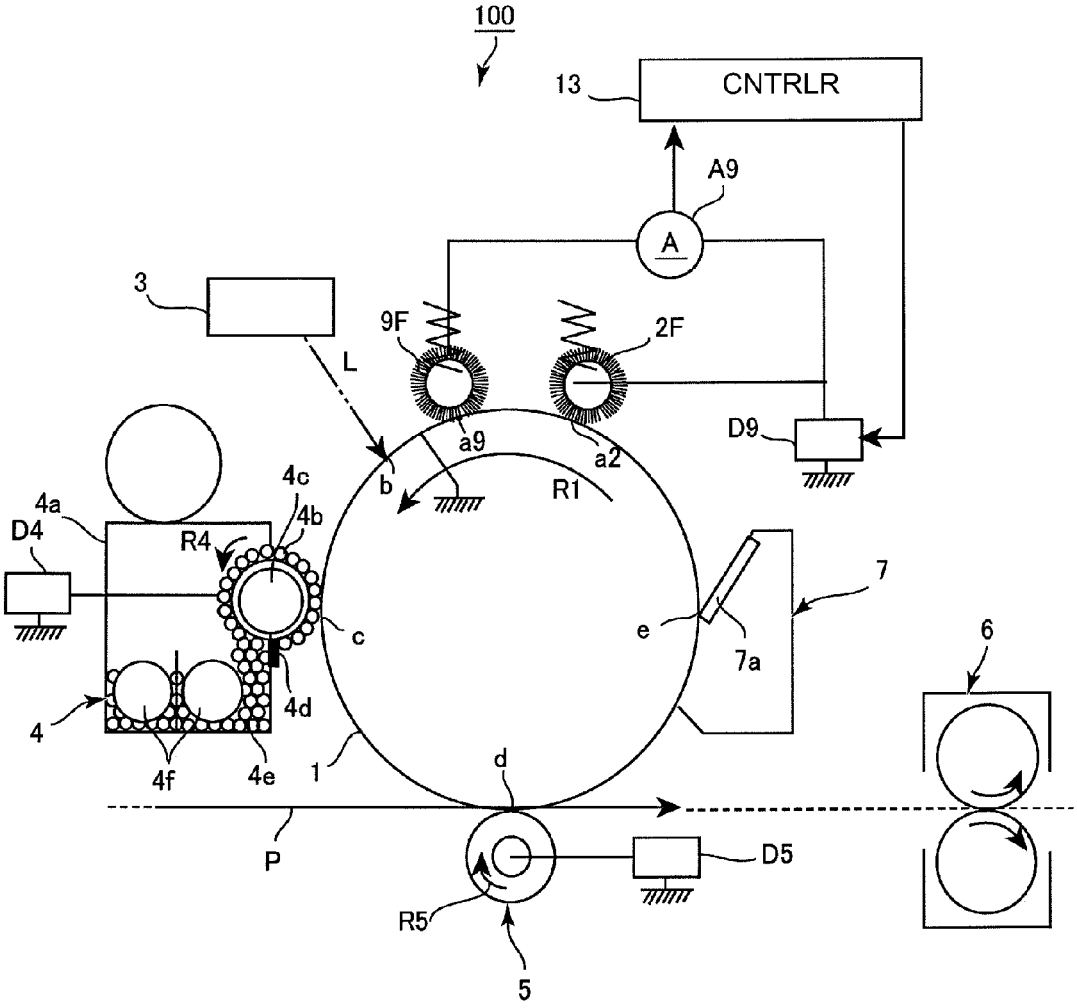

FIG. 13 is an illustration of a structure of an image forming apparatus in Embodiment 2.

Figure 14:
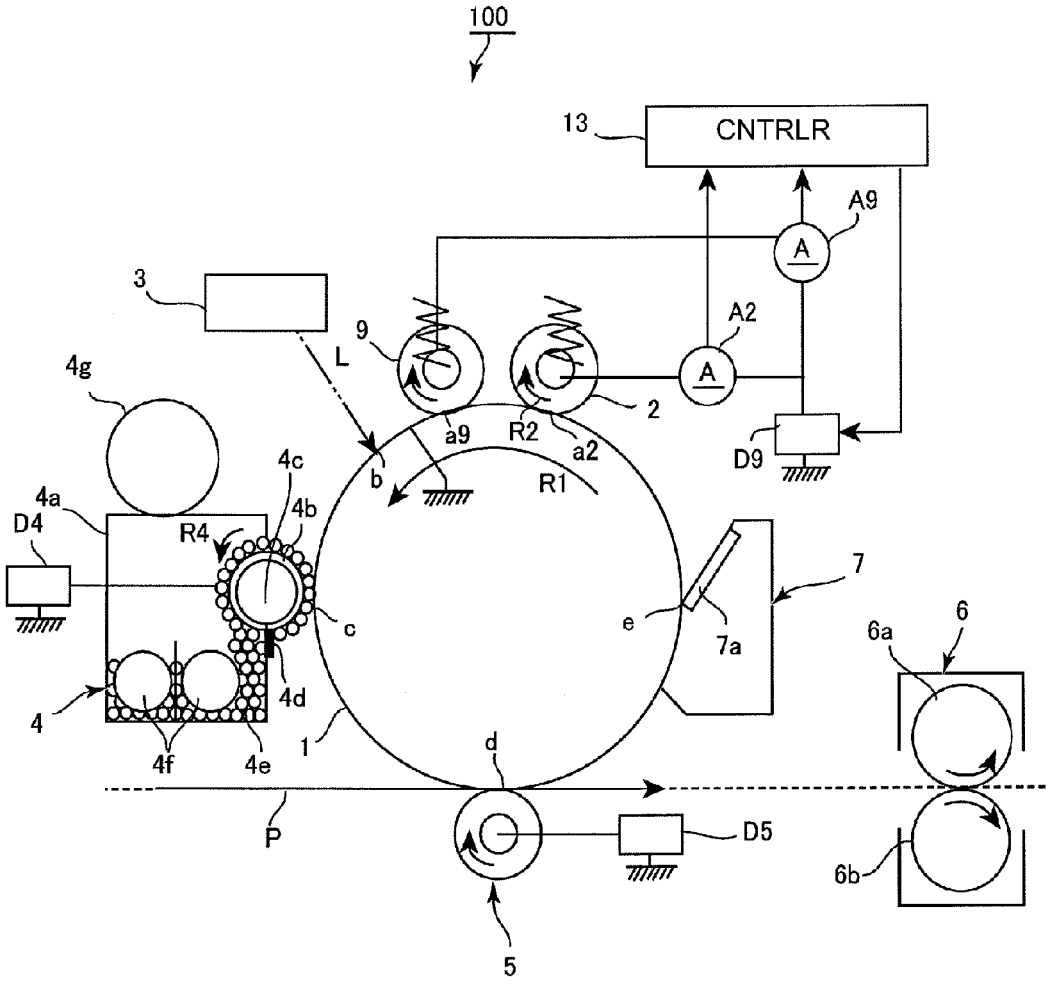
Figure 15:
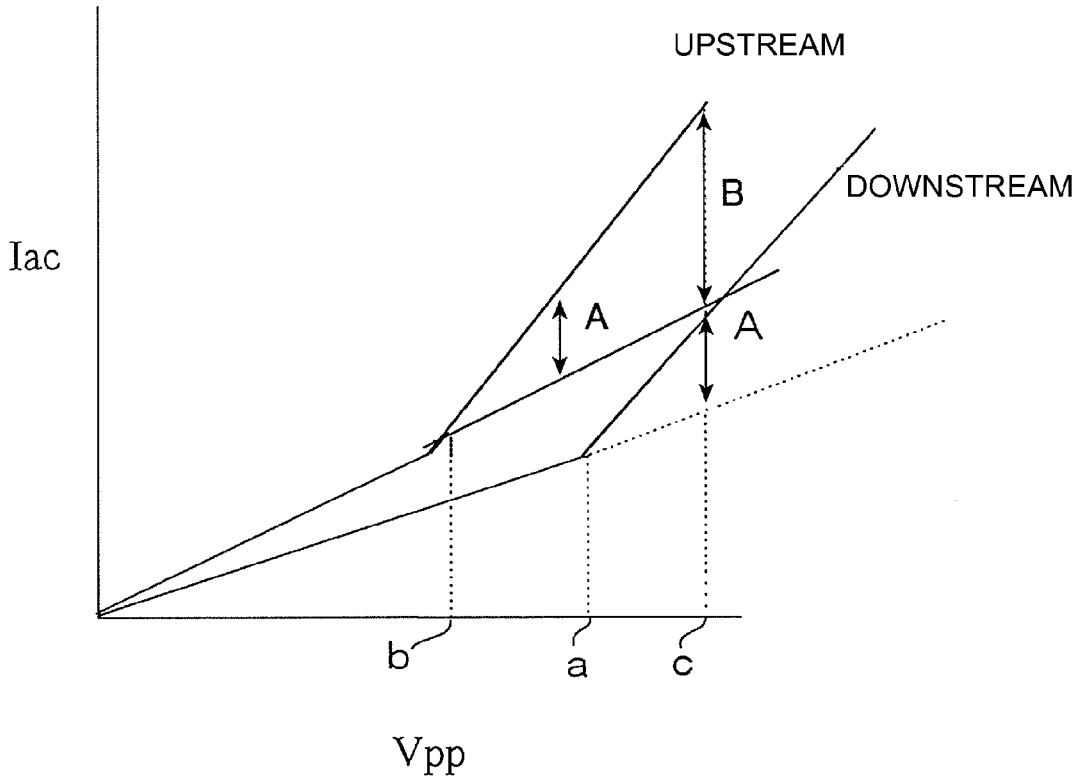

FIG. 14 is an illustration of a structure of an image forming apparatus in Embodiment FIG. 15 is a graph showing a relationship between the peak-to-peak voltage and a detected total current in Embodiment 3.

Figure 16:
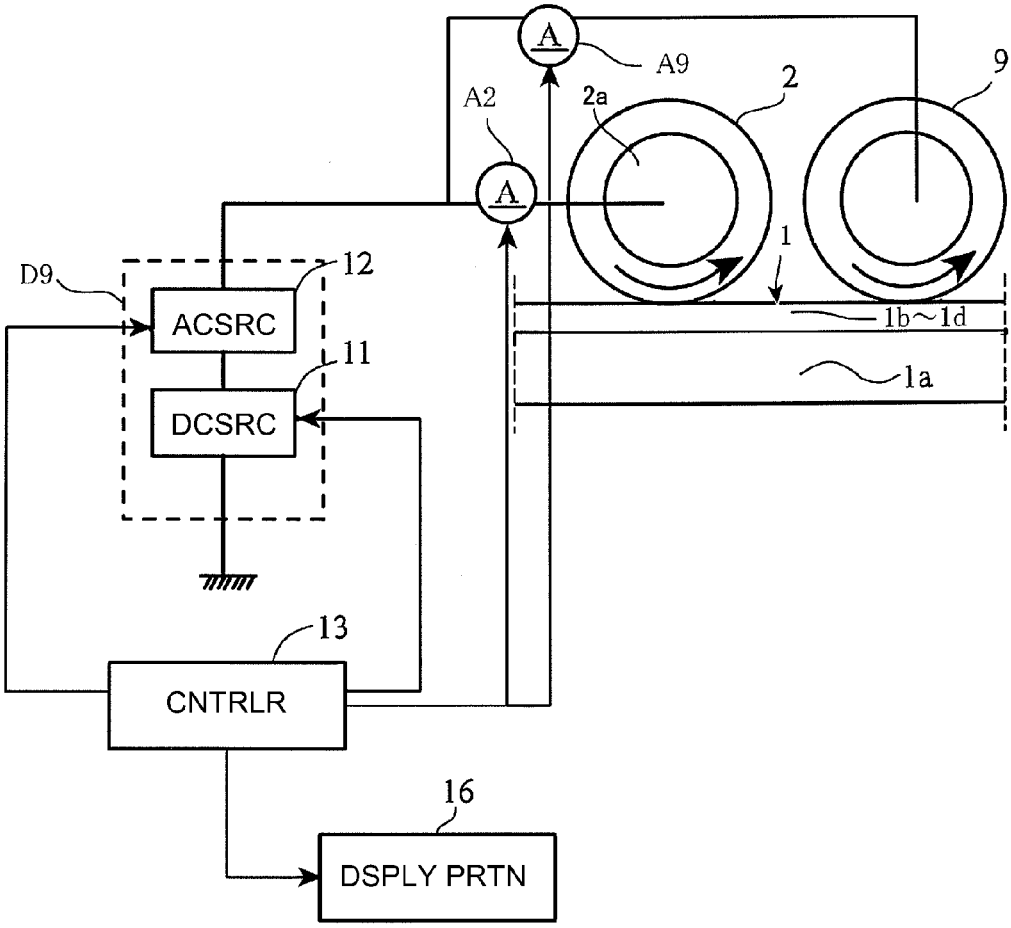

FIG. 16 is a block diagram of a control system of the oscillating voltage in Embodiment 3.

Figure 17:
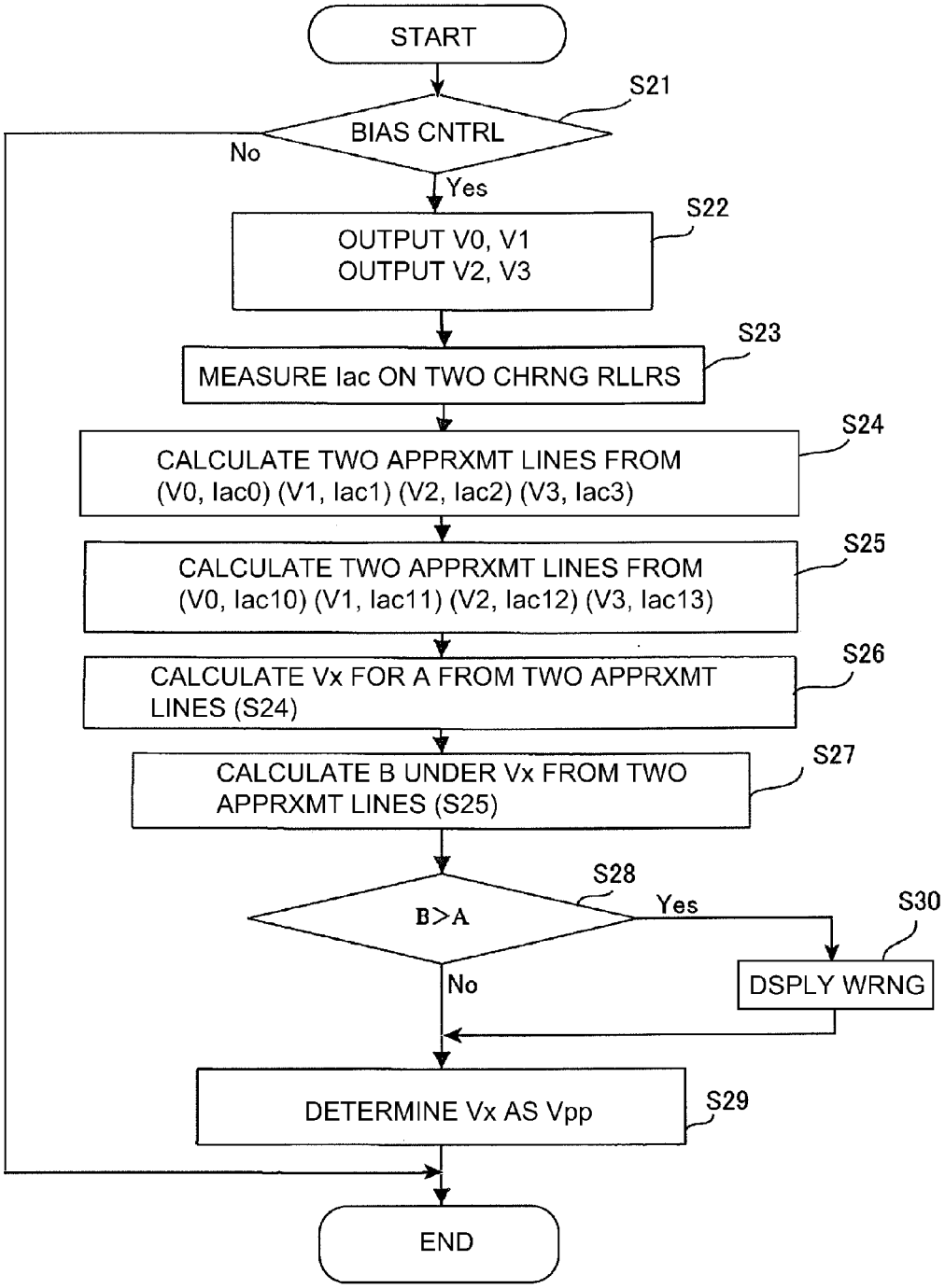

FIG. 17 is a flow chart of AC electric discharge current control in Embodiment 3.

Figure 18:
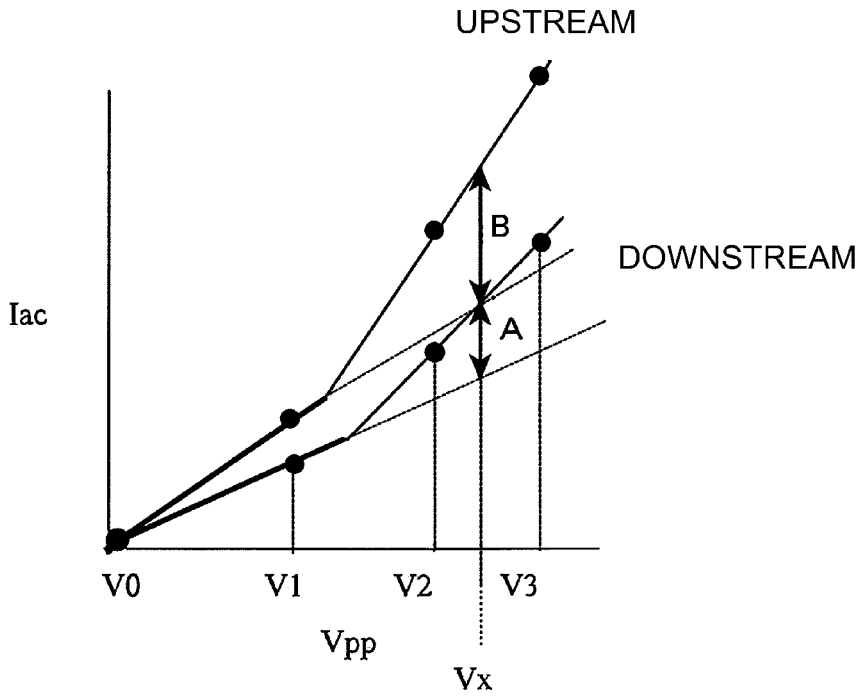

FIG. 18 is an illustration of computing of a peak-to-peak voltage of an AC voltage capable of providing a predetermined electric discharge current.

Figure 19:
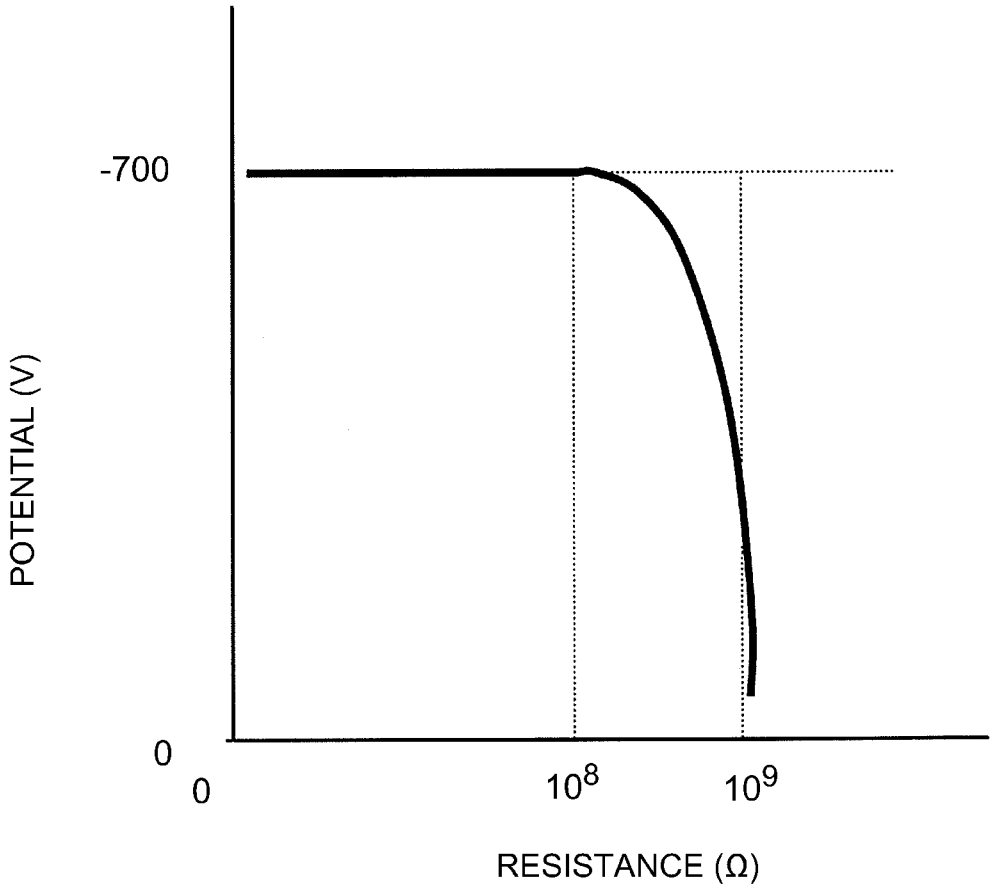

FIG. 19 is an illustration of an upper limit of a resistance value of a charging roller.

DESCRIPTION OF THE PREFERRED EMBODIMENTS

Embodiments of the present invention will be described specifically with reference to the drawings. The present invention can also be carried out in other embodiments in which a part or all of constituent elements are replaced with their alternative constituent elements so long as a common oscillating voltage is applied to a plurality of charging members to charge an image bearing member.

Therefore, the present invention can be carried out irrespective of types such as laser beam exposure/LED array exposure, one-component developer/two-component developer, monochromatic/full-color, intermediary transfer type/recording material conveyance type/direct transfer type, a transfer type and fixing type.

In this embodiment, only a principal part relating to toner image formation and transfer will be described but the present invention can be carried out by image forming apparatuses for various purposes such as printers, various printing machines, copying machines, facsimile machines and multi-function machines by adding necessary device, equipment and casing structure.

Incidentally, general matters of the image forming apparatuses described in JP-A Hei 6-11952, JP-A Hei 8-272194 and JP-A 2001-201921 will be omitted from illustration and redundant explanation.

<Image Forming Apparatus>

Figure 1:
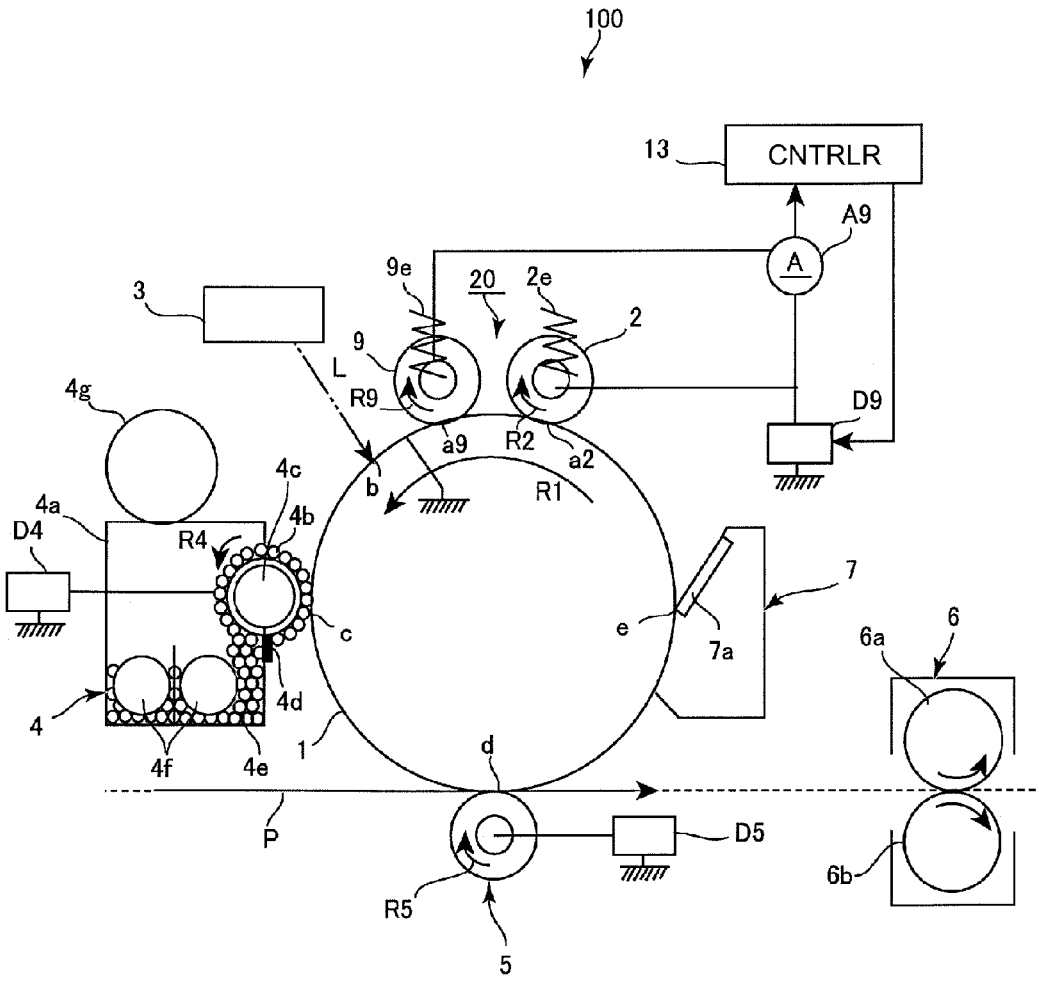
FIG. 1 is an illustration of a structure of an image forming apparatus.
Figure 2:
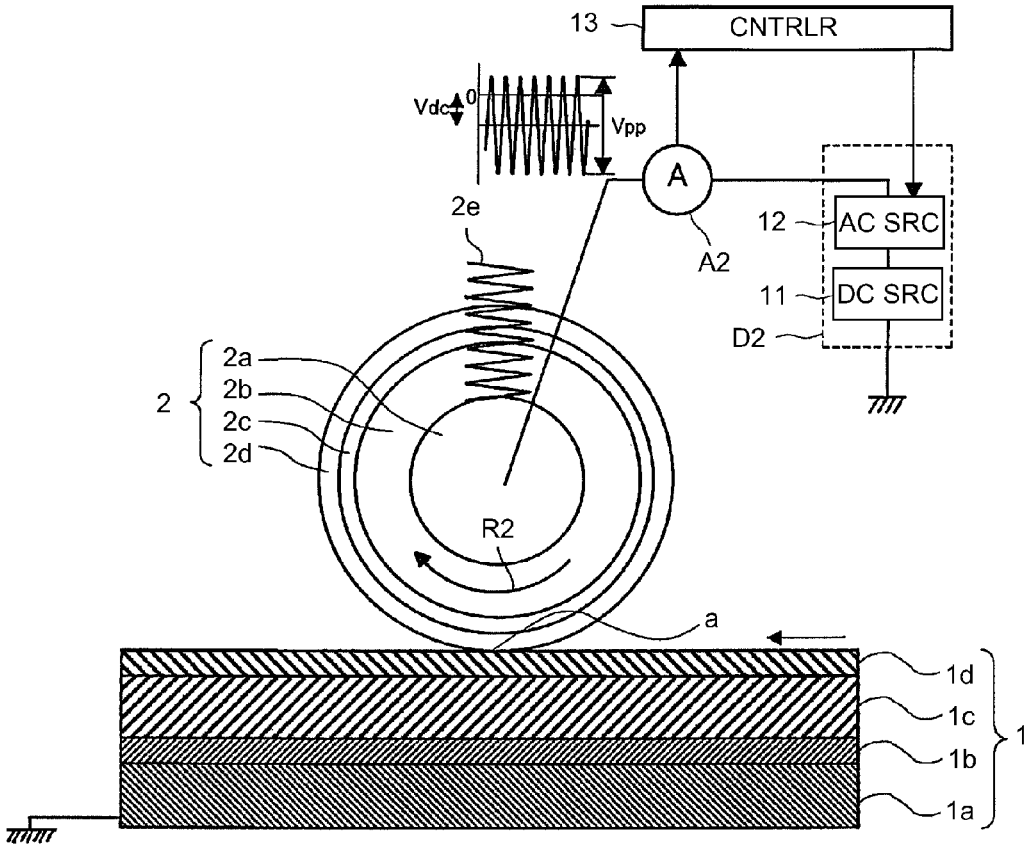
FIG. 2 is an illustration of a layer structure of a photosensitive drum.

FIG. 1 is an illustration of a structure of the image forming apparatus. FIG. 2 is an illustration of a layer structure of a photosensitive drum.

As shown in FIG. 1, an image forming apparatus 100 includes, around a photosensitive drum 1, a charging device 20, an exposure device 3, a developing device 4, a transfer roller 5 and a drum cleaning device 7. The image forming apparatus 100 employs an electrophotographic type, a contact charging type, a two component magnetic brush development type and reverse development type and is a laser beam printer with a maximum recording material size of A3 in portrait orientation feeding.

The photosensitive drum 1 which is an example of the image bearing member is prepared by forming a layer of an organic photoconductor (OPC) having a negative charge polarity on the surface of an aluminum cylinder of 30 mm in outer diameter, and is rotated in an arrow R1 direction at a process speed of 200 mm/sec.

As shown in FIG. 2, the organic photosensitive layer is formed by applying, onto the surface of a drum support 1*a* of the aluminum cylinder, three layers including an undercoat layer 1*b*, a photocharge generating layer 1*c* and a charge transporting layer 1*d* in this order from a lower side.

The charging device 20 charges the surface of the photosensitive drum 1 to a uniform dark-portion potential VD by applying a common DC voltage. The exposure device 3 is constituted by a laser beam scanner using a semiconductor layer and scans the photosensitive drum 1 surface with a laser beam L through a rotating mirror at an exposure position b, so that an electrostatic image for an amount is written (formed) on the surface of the photosensitive drum 1. The surface of the photosensitive drum 1 is subjected to scanning exposure with the laser beam L and thus the potential of the exposed portion of the photosensitive drum 1 is lowered from the dark-portion potential VD to a light-portion potential VL, so that the electrostatic image corresponding to image information is formed.

The developing device 4 develops the electrostatic image with a two-component developer 4*e* in which a toner (non-magnetic) and a carrier (magnetic) are mixed, so that a toner image is formed on the surface of the photosensitive drum 1. The carrier is about $1\times10^{13}$ Ω·cm in volume resistance and 40 μm in particle size. The developer 4*e* is fed by a pair of feeding screws 4*f* in opposite directions to be circulated in a developing container 4*a*, thus being uniformly stirred. By the stirring, the toner and the carrier are triboelectrically charged to the negative polarity and the positive polarity, respectively.

The developing device 4 includes the developing container 4*a* provided with an opening and includes a non-magnetic developing sleeve 4*b* containing a fixed magnet roller 4*c* and provided at the opening. The charged developer 4*e* is coated on the developing sleeve 4*b* by a magnetic force of the fixed magnet roller 4*c* and is regulated in a predetermined layer thickness by a regulating blade 4*d*, so that the developer 4*e* is fed to a developing portion c.

In order to adjust a toner content at a constant level, the toner content in the developing container is detected by an unshown density sensor. On the basis of detected information, the toner in a proper amount is supplied from a toner hopper 4*g* into the developing container 4*a*, so that the toner to be consumed by image formation is replenished.

The developing sleeve 4*b* opposes, at the developing portion c, the photosensitive drum 1 with a gap of 300 μm and is rotated in an arrow R4 direction which is counterdirectionally to the surface of the photosensitive drum 1. A power source D4 applied to the developing sleeve 4*b* an oscillating voltage in the form of a DC voltage of −350 V biased with an AC voltage having a peak-to-peak voltage of, e.g., 1.6 kV.

The transfer roller 5 press-contacts the photosensitive drum 1 with a predetermined pressure to form a transfer portion d. A power source D1 applies to the transfer roller 5 a transfer voltage (+500 V) of the positive polarity opposite to the toner charge polarity, so that the toner image is transferred from the photosensitive drum 1 onto a recording material P nip-conveyed in the transfer portion d.

The fixing device 6 nip-conveys, in a fixing nip, the recording material P having the surface on which the toner image is transferred and heats and presses the toner image, thus heat-fixing the toner means on the recording material P. The fixing device is provided downstream of the transfer portion d and forms the fixing nip by bringing a pressing roller 6*b* into press-contact to a rotatable fixing roller 6*a*.

The drum cleaning device 7 includes a cleaning blade 7*a* at a contact portion e where the cleaning blade 7*a* slides on the photosensitive drum 1 to remove untransferred toner deposited on the photosensitive drum 1 without being transferred onto the recording material P, so that the surface of the photosensitive drum 1 is cleaned.

In the case where the image formation is effected by the electrophotographic method, the electrostatic image corresponding to an original image is formed on an image bearing member surface after the image bearing member surface is uniformly charged and is visualized by the toner, so that the toner image is transferred onto the recording material. The charge and toner remaining on the image bearing member surface after the transfer are removed by a charge-removing device and a cleaning device, respectively, and then the image bearing member prepares for a subsequent image forming operation.

The charging type of the image bearing member includes a contact charging type and a non-contact charging type which employs corona discharge. Of these, the contact charging type receives attention in that an ozone occurrence phenomenon caused in the non-contact charging type is less.

<Charging Device>

Figure 3:
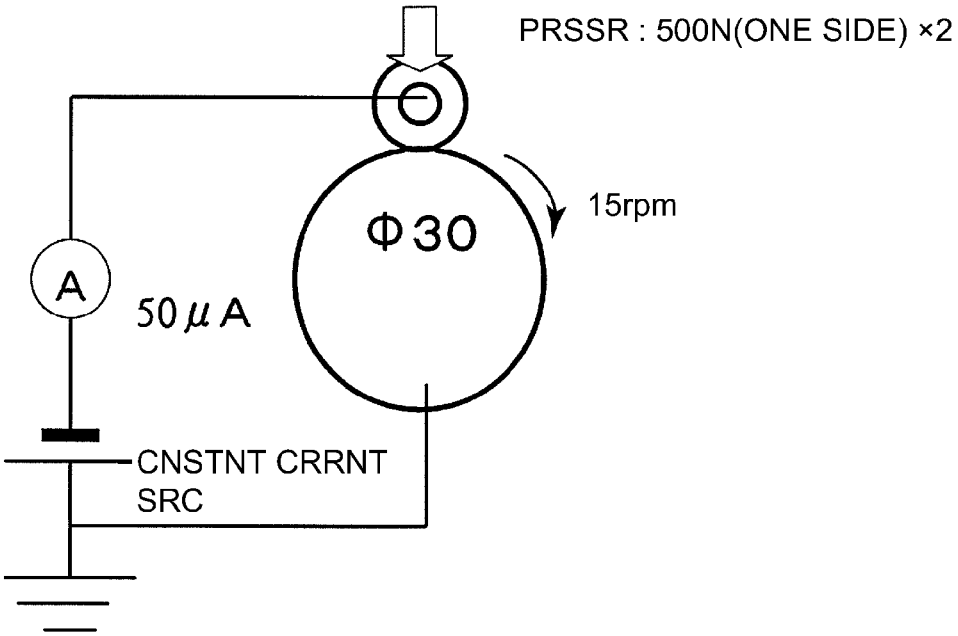
FIG. 3 is an illustration of resistance value measurement of a charging roller.
Figure 4:
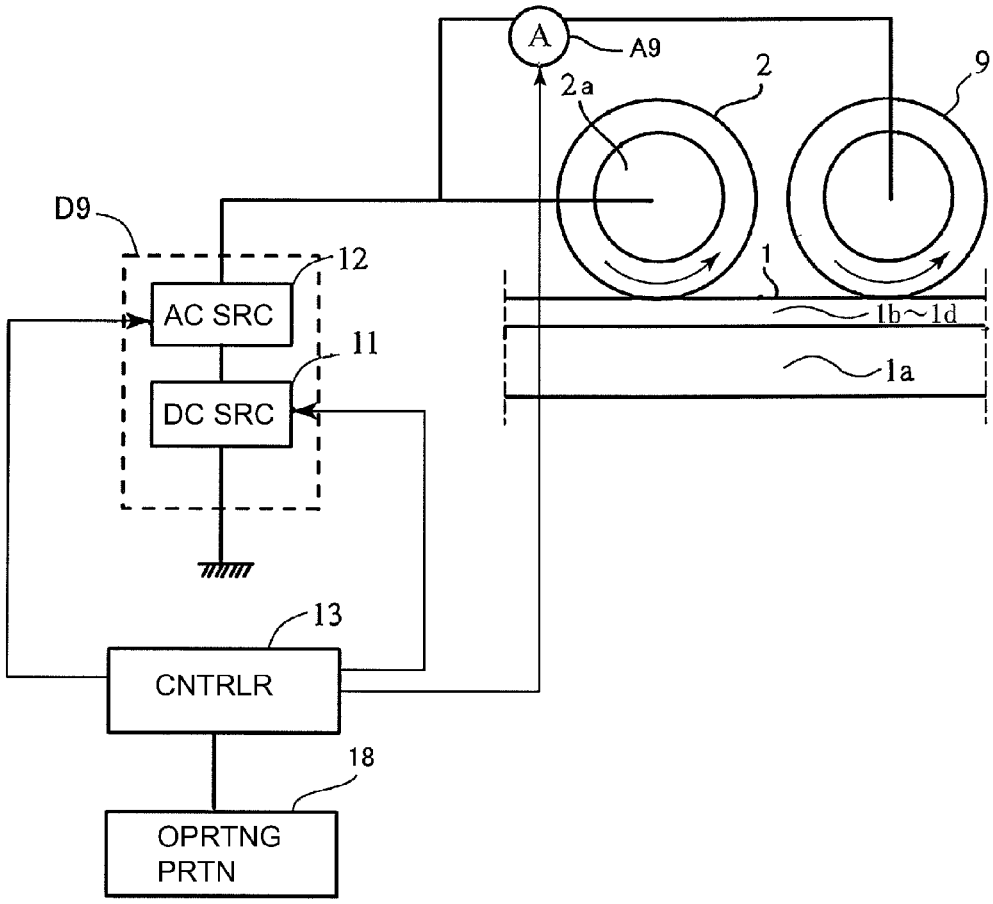
FIG. 4 is a block diagram of a control system of an oscillating voltage applied to two charging rollers.

FIG. 3 is an illustration of charging roller resistance value measurement. FIG. 4 is a block diagram of a control system of an oscillating voltage applied to two charging rollers.

As shown in FIG. 1, the charging device 20 includes a charging roller 2 which is an example of a first charge and a charging roller 9 which is an example of a second charging member. These charging rollers 2 and 9 are contacted to the photosensitive drum 1. The charging rollers 2 and 9 are press-contacted to the surface of the photosensitive drum 1 with predetermined pressure and are rotated by the rotation of the photosensitive drum 1. A press contact portion between the photosensitive drum 1 and the charging roller 2 is a charging portion a2, and a press contact portion between the photosensitive drum 1 and the charging roller 9 is a charging portion a9.

The upstream-side charging roller 2 with respect to a rotational direction of the photosensitive drum 1 includes a core metal 2*a* rotatably held by unshown bearing members at end portions. The upstream-side charging roller 2 is urged toward a center direction of the photosensitive drum 1 by an urging spring 2*e* contacted to the bearing member. The downstream-side charging roller 9 includes a core metal 9*a* rotatably held by unshown bearing members at end portions. The downstream-side charging roller 9 is urged toward a center direction of the photosensitive drum 1 by an urging spring 9*e* contacted to the bearing member.

A power source D9 is provided common to the charging rollers 2 and 9 and applies to the core metals 2*a* and 9*a* a common oscillating voltage in the form of a DC voltage (Vdc) biased with an AC voltage (Vac) with a frequency f, so that the peripheral surface of the photosensitive drum 1 is contact-charged to a predetermined polarity and potential. Specifically, e.g., by using the oscillating voltage in the form of the DC voltage (−500 V) biased with the AC voltage (frequency: 2 kHz, Vpp: 1.6 kV), the peripheral surface of the photosensitive drum 1 is contact-charged to a uniform dark-portion potential VD of −500 V.

Each of the charging rollers 2 and 9 is 320 mm in longitudinal length and has, as shown in FIG. 2, a three-layer structure formed by successively laminating a lower layer 2*b* (9*b*), an intermediate layer 2*c* (9*c*) and a surface layer 2*d* (9*d*) from below on the outer surface of the core metal (shaft supporting portion) 2*a* (9*a*). The lower layers 2*a* and 9*a* are a foamed sponge layer. The surface layers 2*d* and 9*d* are a protective layer provided for preventing an occurrence of leakage even when there is defect such as pin hole on the photosensitive drum 1.

In this embodiment, the specifications of the respective layers are determined as follows.

(1) Core metal 2*a*, 9*a*: round bar of stainless steel having a diameter of 8 mm (2) Lower layer 2*b*, 9*b*: carbon (black)-dispersed foamed EPDM having a specific gravity of 0.5 g/cm$^3$, a volume resistivity of $1\times10^5$ Ω·cm and a layer thickness of 3.0 mm (3) Intermediate layer 2*c*, 9*c*: carbon-dispersed NBR rubber having a volume resistivity of $1\times10^3$ Ω·cm and a layer thickness of 700 μm (4) Surface layer 2*d*, 9*d*: "Toresin" resin of a fluorine-containing compound in which tin oxide and carbon are dispersed to have a volume resistivity of $1\times10^8$ Ω·cm and a layer thickness of 10 μm (5) Resistance value of charging roller 2, 9: $1\times10^6$Ω

(6) Surface roughness Ra (10-point average surface roughness according to JIS): 1.5 μm As shown in FIG. 3, the resistance value of the charging roller was measured in the following manner in a measurement environment of 23° C. and 50% RH. A metal roller of 30 mm in diameter was rotated at 15 rpm. In a state in which both ends of each of the charging rollers 2 and 9 were pressed under a load of 500 N at each side, a constant current of 50 μA was applied and a value of a voltage exerted on each of the charging rollers 2 and 9 was measured, so that the resistance value of each of the charging rollers 2 and 9 was obtained on the basis of a measured value.

A semiconductor resistance layer of each of the charging rollers 2 and 9 is formed of a rubber composition containing a polymer composition and electroconductive powder, as an electroconductive agent, such as carbon black or metal oxide dispersed in the polymer composition. In the case where the electroconductive powder is used as the electroconductive agent, when the electric resistance value of each of the charging rollers 2 and 9 is intended to be set in a range of $1\times10^4$ to $1\times10^9$Ω, a variation in resistance value becomes large.

For this reason, in the semiconductor resistance layer of the charging rollers 2 and 9, the rubber composition or the like in which an ion-conduction type electroconductive agent principally containing a surfactant or the like is added in the polymer composition may also be used. The charging rollers 2 and 9 using the ion-conduction type electroconductive agent have the advantages such that a degree of the variation in electric resistance value is small and a stable electroconductive property is exhibited. However, in the semiconductor roller using the ion-conduction type electroconductive agent, electrostatic interaction between the ion-conduction type electroconductive agent and a polyurethane matrix is large and an electric characteristic is unstable, so that a lowering in performance in continuous use for a long term is early. For that reason, the lifetime of the semiconductor roller becomes relatively short to increase an exchange frequency as the charging rollers 2 and 9, so that the semiconductor roller is disadvantageous economically.

As shown in FIG. 4, the downstream-side charging roller 9 and the upstream-side charging roller 2 are electrically connected and are supplied with a common voltage from the power source D9. The power source D9 includes a DC power source 11 and an AC power source 12, and a current measuring circuit A9 detects an AC current (effective value) passing through the charging roller 9.

A control circuit 13 effects on/off control of the DC power source 11 and the AC power source 12 to apply the DC voltage, the AC voltage or the oscillating voltage in the form of superposed DC voltage and AC voltage to the charging rollers 2 and 9. The control circuit 13 effects constant voltage control of the DC voltage applied from the DC current power source to the charging rollers 2 and 9 and effects constant current control of the peak-to-peak voltage of the AC voltage applied from the AC power source to the charging rollers 2 and 9.

Incidentally, the DC voltage applied from the DC power source 11 to the charging rollers 2 and 9 may also be subjected to the constant current control, and the peak-to-peak voltage of the AC voltage applied from the AC power source 12 to the charging rollers 2 and 9 may also be subjected to the constant voltage control.

As shown in FIG. 1, in order to stably effect high image quality image formation by the image forming apparatus 100, there is a need to control the oscillating voltage so that the electric discharge current passing through the charging rollers 2 and 9 is kept in a proper range to perform uniform charging. In JP-A 2001-201920 and JP-A 2001-201921, an AC electric discharge control method in which the peak-to-peak voltage of the AC voltage of the oscillating voltage is determined during the non-image formation is proposed.

<AC Electric Discharge Current Control Method>

Figure 5:
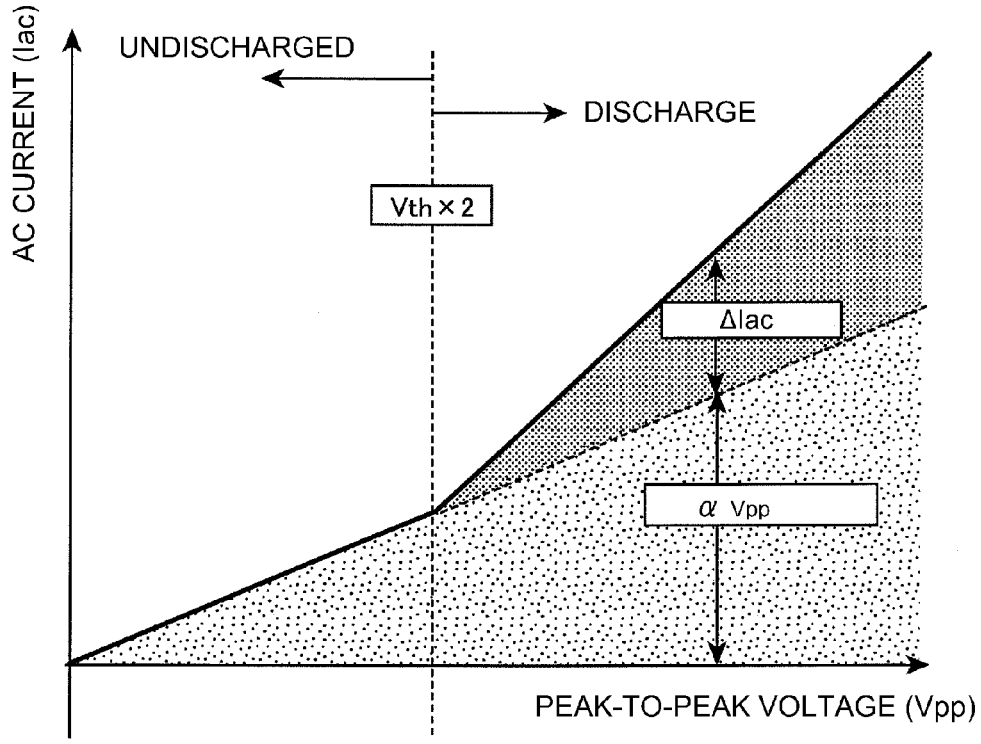
FIG. 5 is an illustration of an undischarged area and a discharged area which depend on an AC voltage.
Figure 6:
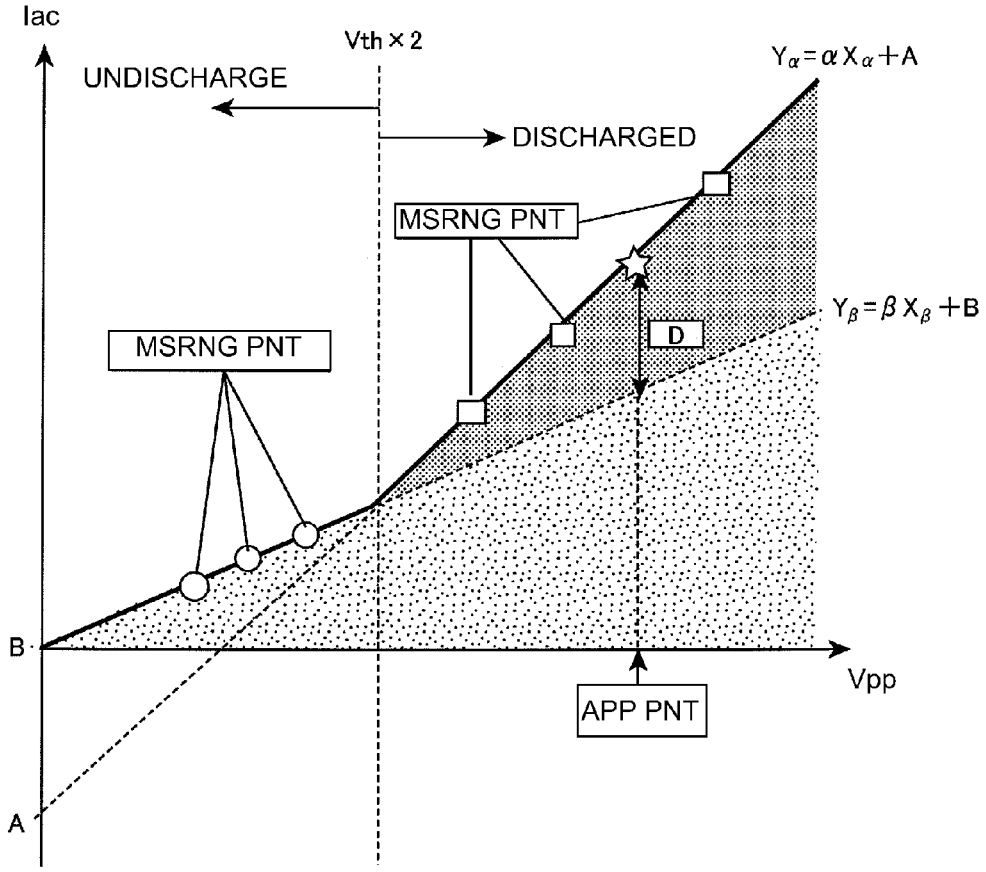
FIG. 6 is an illustration of a relation expression between an applied AC voltage and a measured AC current.
Figure 7:
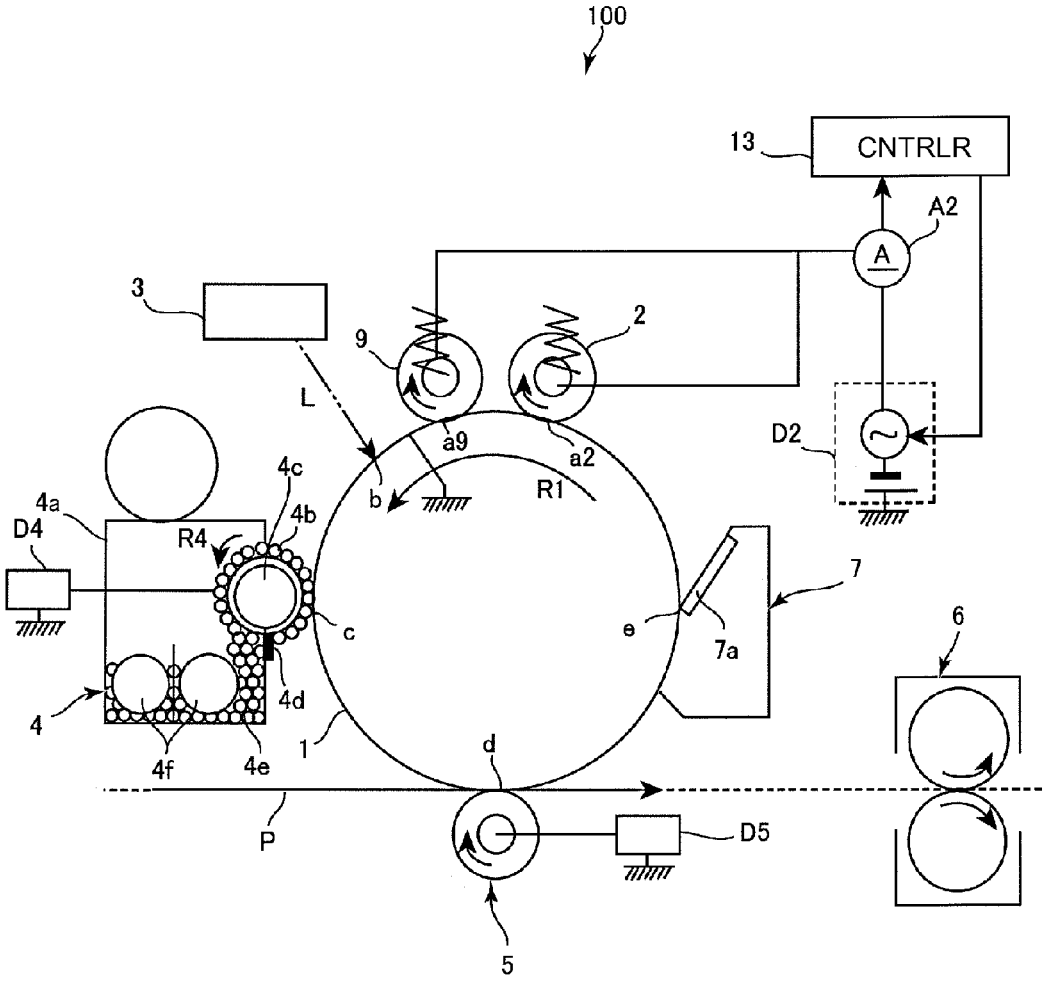
FIG. 7 is an illustration of an image forming apparatus including two charging rollers.

FIG. 5 is an illustration of an undischarged area and a discharged area which depend on an AC voltage. FIG. 6 is an illustration of a relation expression between an applied AC voltage and a measured AC current. FIG. 7 is an illustration of an image forming apparatus including two charging rollers. Parts (a) and (b) of FIG. 8 are illustrations of a problem of AC electric discharge current control the case where the two charging rollers are used.

As shown in FIG. 2, herein, as a prior art, the case where the photosensitive drum 1 is charged by using only the charging roller 2 and the AC voltage of the oscillating voltage is set in the image forming apparatus 100 will be described.

As shown in FIG. 5, an electric discharge start voltage applied to the photosensitive drum 1 when the DC voltage is applied to the charging roller 2 is Vth. At this time, when a maximum amplitude of the AC voltage ((peak-to-peak voltage Vpp)/2) is less than the electric discharge start voltage Vth (V), the voltage area is defined as an undischarged area. When the maximum amplitude of the AC voltage is not less than the electric discharge start voltage Vth (V), the voltage area is defined as a discharged area.

In the case where the peak-to-peak voltage Vpp of the AC voltage is gradually increased from 0 V by applying only the AC voltage to the charging roller 2, a total current Iac detected by the current measuring circuit A2 linearly increases at a proportionality constant $\alpha$ with an increase of the peak-to-peak voltage Vpp in the undischarged area. The proportionarity constant $\alpha$ is a ratio of an increment of the total current Iac to an increment of the peak-to-peak voltage Vpp.

However, when the (peak-to-peak voltage Vpp)/2 exceeds Vth (V) and thus the voltage area enters the discharged area, the total current Iac is deviated from the linear increase state of the proportionality constant $\alpha$, thus being started to increase largely. This is because in the discharged area, the electric discharge occurs in a gap outside the nip in which the charging roller 2 and the photosensitive drum 1 are directly contacted to each other and thus an increment $\Delta$Iac by the electric discharge is added to the total current Iac. This is also confirmed by a similar experiment in vacuum in which the electric discharge does not occur. Specifically, the linear increase state of the constant $\alpha$ is kept even in the area in which the (peak-to-peak voltage Vpp)/2 is not less than the electric discharge start voltage Vth (V).

Accordingly, the total current Iac in the discharged area is, as shown in the following formula 1, equal to addition of the increment $\Delta$Iac by the electric discharge current to the AC current $\alpha$.Vpp passing through the nip. As a substitute for the current amount of the electric discharge, in the following, the increment $\Delta$Iac is defined as an electric discharge current amount.

$$\Delta Iac = Iac - \alpha . Vpp \qquad \text{formula 1}$$

The electric discharge current amount $\Delta$Iac varies depending on a change in environment and a cumulative operation even in both the case where the peak-to-peak voltage Vpp of the AC voltage is subjected to the constant voltage control and the case where the peak-to-peak voltage Vpp is subjected to the constant current control. This is because the resistance and electric discharge environment of the charging roller 2 are changed with the change in environment and the cumulative operation, a relationship between the peak-to-peak voltage Vpp and the electric discharge current amount $\Delta$Iac and a relationship between the AC current Iac and the electric discharge current amount are fluctuated.

Here, it would be considered that the total current Iac flowing from the charging roller 2 to the photosensitive drum 1 is subjected to the constant current control. The total current Iac is the same of the nip current ($\alpha$.Vpp) passing through the contact portion between the charging roller 2 and the photosensitive drum 1 and the electric discharge current amount $\Delta$Iac.

However, in the case where the total current Iac is subjected to the constant current control, the total current Iac including not only the electric discharge current amount $\Delta$Iac, which is a current necessary to actually charge the photosensitive drum 1, but also the nip current ($\alpha$.Vpp) is kept at a constant level.

Therefore, even in the case where the total current Iac is controlled by the same current value, when the resistance of the charging roller 2 is lowered and the nip current ($\alpha$.Vpp) is increased, the electric discharge current amount is decreased and thus the sandpaper-like image is liable to occur. When the resistance of the charging roller 2 is increased and the nip current (α.Vpp) is decreased, the electric discharge current amount ΔIac is increased and thus the image flow is liable to occur.

Therefore, in the AC electric discharge current method, in order to constantly reproduce the electric discharge current amount ΔIac, the peak-to-peak voltage Vpp of the AC voltage is reset in real time and is subjected to the constant voltage control. When the electric discharge current amount in which uniform charging can be performed is D, the constant voltage for the peak-to-peak voltage Vpp of the AC voltage is set so as to provide the electric discharge current amount D.

As shown in FIG. 6 with reference to FIG. 2, during a preparatory rotation operation for printing (so-called pre-rotation), the control circuit 13 sets the peak-to-peak voltage Vpp of the AC voltage of the oscillating voltage used during the image formation. The control circuit 13 controls the AC power source 12 to apply to the charging roller 2 three peak-to-peak voltages Vα1, Vα2 and Vα3 set in the discharged area and then detects total currents Iα1, Iα2 and Iα3 passing through the current measuring circuit A2. Then, the control circuit 13 applies to the charging roller 2 three peak-to-peak voltages Vβ1, Vβ2 and Vβ3 set in the undischarged area and then detects total currents Iβ1, Iβ2 and Iβ3 passing through the current measuring circuit A2.

The control circuit 13 subjects three point data Vα1/Iα1, Vα2/Iα2 and Vα3/Iα3 in the discharged area and three point data Vβ1/I&b1, Vβ2/Iβ2 and Vβ3/Iβ3 in the undischarged area to arithmetic processing as shown in FIG. 6. That is, by using the method of least squares, the relationship between the peak-to-peak voltage Vpp and the total current Iac in each of the discharged area and the undischarged area is subjected to collinear or approximation, so that a formula 2 representing an approximate (rectilinear) line in the discharged area and a formula 3 representing an approximate line in the undischarged area are obtained.

$$Y\alpha=\alpha X+A \qquad \text{formula 2}$$

$$Y\beta=\beta X+B \qquad \text{formula (3)}$$

The control circuit 13 determines, according to a formula 4, the peak-to-peak voltage Vpp at which a difference between the approximate line in the discharged area of the formula 2 and the approximate line in the undischarged area of the formula 3 equal to an electric discharge current amount D.

$$Vpp=(D-A+B)(\alpha-\&b) \qquad \text{formula 4}$$

Then, the peak-to-peak voltage Vpp to be applied to the charging roller 2 is switched to the new peak-to-peak voltage Vpp obtained by the formula 4, so that the operation goes to the image forming operation. During the image formation, the thus obtained peak-to-peak voltage Vpp is subjected to the constant voltage control and then is applied to the charging roller 2.

During every preparatory rotation for the printing, the peak-to-peak voltage Vpp for obtaining the electric discharge current amount D necessary for the image formation is calculated, so that it becomes possible to obtain a desired electric discharge current amount D with reliability.

However, in the case where a common oscillating voltage outputted from the power source D2 was applied to the charging rollers 2 and 9 in parallel as shown in FIG. 7, it was turned out that the AC electric discharge current control method does not function satisfactorily. The relationship between the applied peak-to-peak voltage Vpp and the total current Iac detected by the current measuring circuit A2 does not coincide with that shown in FIG. 6, so that the peak-to-peak voltage Vpp, obtained by the formula 4, providing the electric discharge current amount differs materially from a proper value.

The charging rollers 2 and 9 are different in resistance value, electrostatic capacity and the like and therefore as shown in (a) of FIG. 8, a discharge start point and the electric discharge current amount when the same AC voltage is applied are different between the charging rollers 2 and 9. For this reason, as shown in (b) of FIG. 8, the total current Iac for the charging rollers 2 and 9 shows a line which is bent two times with a change in peak-to-peak voltage Vpp, so that the proper electric discharge current amount D as shown in FIG. 6 cannot be detected.

As shown in (a) of FIG. 8, assuming that the electric discharge start voltage of the downstream-side charging roller 9 is lower than that of the upstream-side charging roller 2, the proper electric discharge current amount of the charging roller 9 is taken as A. At this time, as shown in (b) of FIG. 8, when the peak-to-peak voltage Vpp of the AC voltage is obtained so that the total electric discharge current amount of the charging rollers 2 and 9 is Ax2, a set value therefore is c.

However, as shown in (a) of FIG. 8, when the peak-to-peak voltage Vpp of the AC voltage is subjected to the constant voltage control so as to become c, the electric discharge current amount of the downstream-side charging roller 9 becomes larger than the proper value A, so that the electric discharge current more than necessary flows. As a result, the image flow is liable to occur.

On the other hand, in the case where the electric discharge start voltage of the charging roller 9 is higher than that of the charging roller 2, when the peak-to-peak voltage Vpp of the AC voltage is set so that the total electric discharge current amount of the charging rollers 2 and 9 is Ax2, the electric discharge current amount of the charging roller 9 becomes insufficient and thus the sandpaper-like image occurs.

Therefore, in the following embodiments, only a value of the current passing through the downstream-side charging roller 9 is measured and the peak-to-peak voltage Vpp of the AC voltage to be applied to the charging rollers 2 and 9 is set by the AC electric discharge current control method. By using the AC electric discharge current control method, only the electric discharge current amount for the downstream-side charging roller 9 is properly set, so that an occurrence of excessive electric discharge current at the charging roller 2 is obviated while ensuring charging uniformity. <Embodiment 1>

FIG. 9 is a flow chart of AC electric discharge current control in Embodiment 1. FIG. 10 is a graph showing a relationship between a peak-to-peak voltage and a detected current in Embodiment 1. FIG. 11 is an illustration of a DC current distribution of a charging roller in Embodiment 1. Parts (a), (b) and (c) of FIG. 12 are illustrations of a change with time of a resistance value of the charging roller in Embodiment 1.

As shown in FIG. 4, the charging roller 9 which is an example of the second charging member finally charges the photosensitive drum 1 charged by the charging roller 2 by being supplied with the common oscillating voltage which is common to the charging rollers 2 and 9. The control circuit 13 which is an example of a setting means detects the AC current, by the current measuring circuit 9 which is an example of the detecting means, when a predetermined AC voltage is applied to the downstream-side charging roller 9 during non-image formation. The control circuit 13 applies the AC voltage to the charging rollers 2 and 9 at a plurality of levels and on the basis of a detection result at a plurality of levels of the current measuring circuit 9, the AC voltage of the oscillating voltage used during the image formation is set with the constant voltage so that the AC voltage corresponds to a predetermined electric discharge current value.

In this embodiment, the control circuit 13 sets the AC voltage of the current used during the image formation is set so that the electric discharge current passing between the charging roller 9 and the photosensitive drum 1 is equal to the predetermined value. The setting of the peak-to-peak voltage Vpp of the AC voltage is performed by measuring only the value of the current passing through the downstream-side charging roller 9.

As shown in (b) of FIG. 8, the total current for the charging rollers 2 and 9 is not measured and therefore as shown in FIG. 10, it is possible to obtain a relationship between the peak-to-peak voltage, for which the discharged area and the undischarged area are clearly separated, and the detected total current. As a result, with respect to the downstream-side charging roller 9, the electric discharge current with no excess and no deficiency is set, so that the charging causing no sandpaper-like image and no image flow is executable.

As shown in FIG. 9 with reference to FIG. 4, during the preparatory rotation operation for printing (during the pre-rotation), with control timing of the AC voltage (Yes of S11), the DC power source 11 outputs 0 V. The control circuit 13 controls the AC power source 12 to output successively V0 and V1 in the undischarged area and V2 and V3 in the discharged area (S12).

The control circuit 13 measures AC current values Iac (Iac0, Iac2, Iac2 and Iac3) passing through the charging roller 9 when the respective voltages are applied (S13). Here, in this embodiment, V0=0 V, V1=600 V, V2=1200 V and V3=1500 V were set.

The control circuit 13 calculates the approximate line in the undischarged area from a relationship between the applied voltage and the detected current (V0, Iac0) and (V1, Iac1) with respect to the charging roller 9. Further, the control circuit 13 calculates the approximate line in the discharged area from a relationship between the applied voltage and the detected current (V2, Iac2) and (V3, Iac3) with respect to the charging roller 9 (S14).

As shown in FIG. 10, from the calculated two approximate lines, the peak-to-peak voltage Vpp (Vx) of the AC voltage necessary for a desired electric discharge current A (70 μA in Embodiment 1) is obtained for each color (S15).

The control circuit 13 sets the obtained Vx as the peak-to-peak voltage Vpp of the AC voltage to be applied to both of the charging rollers 2 and 9 in a subsequent operation and the ends the control (S16).

As shown in FIG. 6, in the AC electric discharge current control in Embodiment 1, the electric discharge start voltage when the DC voltage is applied to the charging member is Vth. At this time, current values when the peak-to-peak voltage Vpp less than a value which is two times the voltage Vth and when two or more points of the peak-to-peak voltage Vpp not less than the value which is two times the voltage Vth are measured. Then, on the basis of a measurement result, a relationship between the peak-to-peak voltage of the AC voltage and the current value, so that the peak-to-peak voltage of the AC voltage necessary to obtain a desired electric discharge current value is determined. Then, the relationship between the peak-to-peak voltage Vpp of the charging AC voltage and the AC current is actually measured, so that the peak-to-peak voltage Vpp of the AC voltage necessary to obtain the desired electric discharge current value is determined.

In this embodiment, the charging rollers 2 and 9 are automatically role-shared so that the upstream-side charging roller 2 roughly charges the photosensitive drum 1 to a target potential and the downstream-side charging roller 9 uniformly charges the photosensitive drum 1 to the target potential. For that reason, even when the electric discharge current amount for the upstream-side charging roller 2 is decreased to a small value at which the sandpaper-like image occurs, there is no problem since the upstream-side charging roller 2 is directed to roughly pre-charge the photosensitive drum 1. That is, the photosensitive drum 1 is roughly charged to the target potential or less by the upstream-side charging roller 2 and then is uniformly charged to the target potential by the downstream-side charging roller 9.

As a result, as shown in FIG. 11, the DC current passing through the upstream-side charging roller 2 automatically becomes larger than that passing through the downstream-side charging roller 9. FIG. 11 shows a process speed (mm/sec) dependency when the oscillating voltage in the form of the DC voltage Vdc=−500 V biased with the AC voltage (frequency=2.0 kHz, peak-to-peak voltage Vpp=1.7 kV, sine wave) is applied to the charging rollers 2 and 9.

As shown in FIG. 11, at the process speed of 200 mm/sec in this embodiment, a ratio of DC current passing through the upstream-side charging roller 2 and the downstream-side charging roller 9 is 96.9/3.1. That is, the amount of the downstream-side passing through the upstream-side charging roller 2 is about 30 times larger than that of the DC current passing through the downstream-side charging roller 9.

As shown in FIG. 12, as a result, a resistance increasing speed of the downstream-side charging roller 9 is slower than that of the upstream-side charging roller 2. Therefore, the charging rollers with the same design are used, the increasing speed of the resistance value of the upstream-side charging roller 2 is higher than that of the downstream-side charging roller 9.

As shown in (a) of FIG. 8, the resistance of the charging roller 2 becomes higher with cumulative image formation, so that the electric discharge start voltage Vth=b of the upstream-side charging roller 2 is higher than the electric discharge start voltage Vth=a of the downstream-side charging roller 9. As a result, when the electric discharge current of the downstream-side charging roller 9 is set at the proper value A, the electric discharge current of the upstream-side charging roller 2 does not become A or more. Therefore, the upstream-side charging roller 2 does not cause the image flow due to excessive occurrence of the electric discharge product generated by passing of the excessive electric discharge current.

Further, when the resistance value of the upstream-side charging roller 2 is increased, the charge potential by the charging roller 2 is lowered and therefore the DC current passing through the downstream-side charging roller 9 is increased, so that the resistance value of the downstream-side charging roller 9 is also increased so as to follow the resistance value of the upstream-side charging roller 2. For this reason, the charging rollers 2 and 9 are autonomously balanced to be increased in resistance value, so that the charging rollers 2 and 9 reach their exchange lifetimes at the substantially same time. Therefore, the exchange rate of the charging rollers 2 and 9 is lower than that in the case where the charging rollers 2 and 9 separately reach their exchange lifetimes.

However, in a rare case where an initial charging roller resistance value is higher at the upstream side than at the downstream side only at an initial operation stage, the electric discharge current of the upstream-side charging roller 2 becomes excessive. However, also in this case, by the above-described difference in resistance value increasing speed, the resistance value of the upstream-side charging roller 2 passes that of the downstream-side charging roller 9 soon, so that the autonomous exchange lifetime adjustment is made.

In Embodiment 1, the AC electric discharge current control is executed with predetermined timing during non-image formation. In the case where the electric discharge start voltage applied to the image bearing member when the DC voltage is applied to the charging member is Vth, at least one point of the peak-to-peak voltage Vpp which is less than two times the voltage Vth and at least two points of the peak-to-peak voltage Vpp which is not less than two times the voltage Vth are applied to the charging means. Then, from the AC current value measured in each of voltage application states, the peak-to-peak voltage of the AC voltage to be applied from the common AC voltage power source to the charging means during the image formation is determined.

In this embodiment, the variation in resistance value and non-uniformity of the applied high voltage which are caused due to the environment fluctuation, the variation in charging roller and the environmental fluctuation of the material can be absorbed. Further, it is possible to avoid the application of the peak-to-peak voltage Vpp of the excessive AC voltage, so that a degree of the photosensitive drum abrasion by sliding friction with the cleaning blade is small.

In this embodiment, the electric discharge current is controlled at a minimum level and therefore the electric discharge product generated by the electric discharge is deposited on the photosensitive drum, so that the image flow occurring by the lowering in surface resistance of the photosensitive drum is reduced. At the same time, it is possible to obviate the insufficient peak-to-peak voltage Vpp of the AC voltage and therefore a degree of charge potential non-uniformity of the photosensitive drum resulting from the charging roller resistance non-uniformity is decreased, so that charging uniformity is enhanced and thus the sandpaper-like image generated by development of a portion of charge potential non-uniformity is prevented.

Therefore, in the charging device including the plurality of the charging rollers, the AC voltage applied to the downstream-side charging roller 9 which is important for the charging uniformity is optimized, so that the image defect such as the sandpaper-like image and the image flow can be reduced. At the same time, the increase in lifetime of the photosensitive drum and the charging rollers can be achieved. In the case where the common high-voltage power source was connected to the plurality of the charging rollers, it became possible to prevent the occurrences of the sandpaper-like image and the image flow by optimizing the AC voltage applied to the downstream-side charging roller which is important for the charging uniformity.

In this embodiment, the two charging rollers are used but even in the case where three or more charging rollers are used, the charging roller which is important for the charging uniformity is the downstreammost charging roller and therefore a similar effect can be obtained by controlling the AC voltage applied to the downstreammost charging roller. <Embodiment 2>

FIG. 13 is an illustration of a structure of the image forming apparatus in Embodiment 2. In Embodiment 1, the charging rollers were used as the two charging members but in Embodiment 2, fur brushes were employed in place of the charging rollers.

As shown in FIG. 13, fur brushes 2F and 9F as the charging member are disposed in contact with the photosensitive drum 1. The fur brushes 2F and 9F are driven by an unshown motor and are rotated in the same direction as that of the photosensitive drum 1 at a peripheral speed which is about 1.4 times the peripheral speed of the photosensitive drum 1 to slide on the photosensitive drum 1.

As the fur brushes 2F and 9F, e.g., fibers (threads) for forming the brush are woven in a flat plate-like base cloth and then are cut in an appropriate size followed by winding about a core metal in a spiral shape to be finished in a roller shape of a woven fabric type. It is also possible to use an electrostatic fiber-planting type in which an adhesive is applied onto the core metal in advance and the fibers (threads) but in the substantially same length as that of the fibers finally constituting the fur brush are stabbed into the core metal by an electrostatic force to be fished into a roller shape.

As the material for the fibers of the fur brushes 2F and 9F, it is possible to use nylon, acrylic resin, polyethylene terephthalate, polyimide, rayon, triacetate, cupra and the like. However, in order to impart electroconductivity, carbon black or an anion conductive agent is added.

The fiber length of the fur brushes 2F and 9F is not particularly defined but may desirably be 4.0 mm or less from the viewpoints of permanent deformation by fiber tilting, unnecessity of a driving device, and the like.

In this embodiment, the fur brushes 2F and 9F were formed of nylon as the fiber material and have a thickness of 4 denier, a length of 2 mm and a density of 150 kF/inch$^2$. More specifically, the specifications of the fur brushes 2F and 9F are as follows.

The fur brush 2F includes a round bar core metal of stainless steel having a diameter of 8 mm and carbon-dispersed nylon fiber brush having the thickness of 4 denier, the density of 150 kF/inch$^2$ and the fiber length of 2 mm. The resistance value of the fur brush 2F is $1\times10^6\Omega$ and circumferential resistance non-uniformity (Rmax/Rmin) is 2.4. A reference increasing rate of the fur brush 2F is 3.0. Incidentally, the measuring methods of the resistance value and the resistance increasing rate are as described above with reference to FIG. 3.

The fur brush 9F includes a round bar core metal of stainless steel having a diameter of 8 mm and an ion conductive agent-dispersed nylon fiber brush having the thickness of 4 denier, the density of 150 kF/inch$^2$ and the fiber length of 2 mm. The resistance value of the fur brush 9F is $1\times10^6\Omega$ and circumferential resistance non-uniformity (Rmax/Rmin) is 2.4. A reference increasing rate of the fur brush 2F is 3.0.

Also in Embodiment 2, similarly as in Embodiment 1, in the charging device including the plurality of charging brushes, the AC voltage applied to the downstream-side charging brush which is important for the charging uniformity is optimized. As a result, the image defect such as the sandpaper-like image or the image flow was reduced and it was possible to achieve the increase in lifetime of the photosensitive drum and the charging brushes.

FIG. 14 is an illustration of a structure of an image forming apparatus in Embodiment 3. FIG. 15 is a graph showing a relationship between the peak-to-peak voltage and a detected total current in Embodiment 3. FIG. 16 is a block diagram of a control system of the oscillating voltage in Embodiment 3. FIG. 17 is a flow chart of AC electric discharge current control in Embodiment 3. FIG. 18 is an illustration of computing of a peak-to-peak voltage of an AC voltage capable of providing a predetermined electric discharge current.

As shown in FIG. 14, in this embodiment, when the control circuit 14 judges, on the basis of detection results of the current measuring circuits A2 and A9, that the electric discharge current is excessive on the upstream-side charging roller 2, the control circuit 13 provides warning of the image flow. In the case where the AC current passing through the charging roller 2 is larger than that passing through the charging roller 9, the warning is outputted to a display control portion 16 which is an example of a warning means. The current measuring circuit A2 is connected to the upstream-side charging roller 2 to detect an effective value of the AC current passing through the charging roller 2. The current measuring circuit A9 is connected to the downstream-side charging roller 9 to detect the effective value of the AC current passing through the charging roller 9.

The control circuit 13 effects, similarly as in Embodiment 1, the constant voltage control of the AC voltage of the oscillating voltage during the image formation by using the constant voltage of the peak-to-peak voltage Vpp determined so that the electric discharge current of the downstream-side charging roller 9 is the proper value A.

In the case where the electric discharge current value B of the upstream-side charging roller 2 is larger than the electric discharge current value A of the downstream-side charging roller 9 when the AC voltage having the set peak-to-peak voltage Vpp is applied, the control circuit 13 displays the warning massage at the display control portion 16. The control circuit 13 judges that the electric discharge current passing through the upstream-side charging roller 2 is excessive and provides warning of the image flow.

Other constitutions and control are similar to those in Embodiment 1 described with reference to FIG. 4, so that the constituent members shown in FIG. 16 will be represented by reference numerals or symbols common to those in FIG. 4 and will be omitted from redundant description.

As described in Embodiment 1, in the case where the electric discharge start voltage Vth=b of the charging roller 2 is slower than the electric discharge start voltage Vth=a of the charging roller 9, when the electric discharge current passing through the charging roller 9 is set at the power value A, the electric discharge current passing through the charging roller 2 becomes excessive.

As shown in FIG. 15, when the electric discharge current passing through the charging roller 9 is made equal to a, the electric discharge current passing through the charging roller 2 is increased from A to B, so that the image flow, the drum abrasion and the like are liable to occur. Therefore, in Embodiment 3, in the case where the electric discharge current passing through the downstream-side charging roller 9 is controlled, the current passing through the upstream-side charging roller 2 is also detected in addition to that passing through the downstream-side charging roller 9, so that the warning of the image is outputted.

As shown in FIG. 17 with reference to FIG. 16, during the preparatory rotation operation for printing (during the pre-rotation), with control timing of the AC voltage (Yes of S21), the DC power source (current circuit) 11 outputs 0 V. The control circuit 13 controls the AC power source 12 to output successively V0 and V1 in the undischarged area and V2 and V3 in the discharged area (S22).

The control circuit 13 measures AC current values Iac (Iac0, Iac2, Iac2 and Iac3) passing through the charging roller 9 when the respective voltages are applied. At the same time, the control circuit 13 measures AC current values Iac passing through the charging roller 2 when the respective voltages are applied (S23). Here, also in this embodiment, V0=0 V, V1=600 V, V2=1200 V and V3=1500 V were set.

The control circuit 13 calculates the approximate line in the undischarged area from a relationship between the applied voltage and the detected current (V0, Iac0) and (V1, Iac1) with respect to the charging roller 9. Further, the control circuit 13 calculates the approximate line in the discharged area from a relationship between the applied voltage and the detected current (V2, Iac2) and (V3, Iac3) with respect to the charging roller 9 (S24).

The control circuit 13 calculates the approximate line in the undischarged area from a relationship between the applied voltage and the detected current (V0, Iac0) and (V1, Iac1) also with respect to the charging roller 2. Further, the control circuit 13 calculates the approximate line in the discharged area from a relationship between the applied voltage and the detected current (V2, Iac2) and (V3, Iac3) with respect to the charging roller 9 (S25).

As shown in FIG. 18, from the calculated two approximate lines, the peak-to-peak voltage Vpp (Vx) of the AC voltage necessary for a desired electric discharge current A (70 μA also in Embodiment 3) is obtained by the control circuit 13 with respect to the charging roller 9 (S26).

The control circuit 13 obtains the electric discharge current B, generated when the AC voltage having the peak-to-peak voltage Vpp (Vx) is applied, from the calculated two approximate lines with respect to the charging roller 2 (S27). The control circuit 13 compares the electric discharge current A of the charging roller 9 and the electric discharge current B of the charging roller 2 (S28). Then, in the case of B>A (Yes of S28), the control circuit 13 sets the warning such that the electric discharge current of the charging roller 2 is slightly excessive (S30).

The control circuit 13 sets the obtained Vx as the peak-to-peak voltage Vpp of the AC voltage to be applied to both of the charging rollers 2 and 9 in a subsequent operation and the ends the control (S29).

In Embodiment 3, the electric discharge current amount B of the upstream-side charging roller 2 and the target electric discharge current amount A of the downstream-side charging roller 9 are compared and in the case of B>A, the warning such that the electric discharge current amount of the upstream-side charging roller is slightly excessive is set. In this embodiment, in the case where a value to be compared with B is A but when the electric discharge current value at which the image flow occurs is 150 μA, the value may also be 150 μA which is different from A. Further, it is also possible to judge the electric discharge current that the electric discharge current is not directly obtained but is excessive when the AC current value measured by the current measuring circuit A2 is larger than that measured by the current measuring circuit A9.

In this embodiment, the AC current detecting means for detecting the AC current passing through the charging member other than the downstream-side charging member is provided and in the case where the AC current passing through the charging device other than the downstream-side charging device is out of a certain range, the warning massage is displayed. In the charging device including the plurality of the charging rollers, the AC voltage applied to the downstream-side charging roller 9 which is important for the charging uniformity is optimized to accomplish the uniform charging. In addition, the current passing through the upstream-side charging roller 2 is detected and in the case where the electric discharge current amount is the certain value or more, the warning or the like is provided, so that the occurrence of the in convenience such as the image flow is reduced.

In this embodiment, the constitution of the monochromatic printer is described but the object of the present invention can also be accomplished also in the full-color printer by effecting similar control for each color. In the case of the full-color printer, the warning may desirably be provided every color. This is because by setting the warning every color, the charging roller can be exchanged with respect to only a necessary color and the amount of consumption of the toner for the toner band can be reduced by forming the toner band for preventing the image flow with the use of only the necessary color.

<Embodiment 4>

In Embodiment 3, the warning is set in the case where the electric discharge current amount of the upstream-side charging roller is excessive. However, in Embodiment 4, not only the warning but also the control for removing the electric discharge product are automatically effected positively since there is a possibility that the inconvenience such as the image flow, or the like is caused. Other constitutions and control are identical to those in Embodiment 3 and will be described with reference to FIG. 16 and omitted from redundant description.

As shown in FIG. 16, in this embodiment, the AC current detecting means A2 for detecting the AC current passing through the downstream-side charge 2 is provided and the image forming condition is changed in the case where the AC current passing through the downstream-side charging member 2 is out of a certain range. In the case where the AC current passing through the charging roller 2 is larger than that passing through the charging roller 9, the control circuit 13 executes the control for removing the electric discharge product by the charging from the photosensitive drum 1.

The current for removing the electric discharge product is at least one of the following operations (1) to (6).

(1) A cleaning toner image is formed by band-like exposure of the photosensitive drum 1 to light with respect to the main scan direction and is supplied to an end of the cleaning blade 7*a* of the drum cleaning device 7 without being transferred at the transfer portion d.

(2) A frequency of the toner supply to the end of the cleaning blade 7*a* is increased by a method other than the formation of the band-like toner image.

(3) The time of idling during the preparatory rotation operation for the printing (so-called pre-rotation) is increased.

(4) The time of idling of the photosensitive drum 1 without applying the charging high voltage after the image formation is increased.

(5) During the maintenance of the image forming apparatus 100, the upstream-side charging roller of the charging device to which the warning is provided is interchanged with the downstream-side charging roller.

(6) The upstream-side charging roller 2 is connected to a resistor, so that the electric discharge current is optimized so as not to become excessive.

<Embodiment 5>

FIG. 19 is an illustration of the upper limit of the charging roller resistance value. In this embodiment, in order to obviate the excessive electric discharge current passing through the upstream-side charging roller 2, the resistance value of the upstream-side charging roller 2 in the initial shipment state was set at a value larger than that of the downstream-side charging roller 9. As a result, the necessity for outputting the warning as in Embodiment 3 or executing the current for removing the electric discharge product as in Embodiment 4 was obviated.

In this embodiment, the specifications of the charging rollers 2 and 9 at the initial shipment state are as follows. The surface roughness is represented by 10 point average surface roughness Ra according to JIS.

[Charging Roller 2]

(1) Core metal 2*a*: round bar of stainless steel having a diameter of 8 mm (2) Lower layer 2*b*: carbon (black)-dispersed foamed EPDM having a specific gravity of 0.5 g/cm$^3$, a volume resistivity of $1\times10^5$ Ω·cm and a layer thickness of 3.0 mm (3) Intermediate layer 2*c*: carbon-dispersed NBR rubber having a volume resistivity of $1\times10^3$ Ω·cm and a layer thickness of 700 μm (4) Surface layer 2*d*: "Toresin" resin of a fluorine-containing compound in which tin oxide and carbon are dispersed to have a volume resistivity of $1\times10^8$ Ω·cm, a surface roughness of 1.5 μm and a layer thickness of 10 μm (5) Resistance value of charging roller 2: $1\times10^7$Ω

[Charging Roller 9]

(1) Core metal 9*a*: The same as the charging roller 2

(2) Lower layer 9*b*: carbon (black)-dispersed foamed EPDM having a specific gravity of 0.5 g/cm$^3$, a volume resistivity of $1\times10^5$ Ω·cm and a layer thickness of 3.0 mm (3) Intermediate layer 9*c*: the same as the charging roller 2

(4) Surface layer 9*d*: "Toresin" resin of a fluorine-containing compound in which tin oxide and carbon are dispersed to have a volume resistivity of $1\times10^7$ Ω·cm, a surface roughness of 1.5 μm and a layer thickness of 10 μm (5) Resistance value of charging roller 9: $1\times10^6$Ω

As shown in FIG. 2, in the case where the resistance value of the charging roller 2 at the initial shipment state is excessively low and thus the detectors or the like occurs in the surface layer of the photosensitive drum 1, there is a possibility that leakage occurs at the drum base member 1*a* of the photosensitive drum 1 when the AC voltage is applied. For this reason, the resistance value of the charging roller 2 may desirably be $1\times10^4$Ω or more.

However, when the resistance value of the charging roller 2 is too high, the photosensitive drum 1 cannot be charged. FIG. 18 is a result of checking of the relationship between the charging roller resistance value and the photosensitive drum charge potential in the case where the process speed is 200 mm/sec and the oscillating voltage is in the form of the DC voltage of −700 V biased with the AC voltage of 2 kHz in frequency and 1.8 kV in peak-to-peak voltage Vpp.

As shown in FIG. 18, when the charging roller resistance value exceeds $1\times10^8$Ω, the charge potential cannot converge to the DC voltage (−700 V).

Further, when the charging roller resistance value exceeds $1\times10^9$Ω, the photosensitive drum charge potential does not reach ½ of the DC voltage (−700).

For that reason, the upper limit of the resistance value of the downstream-side (downstreammost) charging roller for which the charge potential is finally converged to the DC voltage (−700 V) may desirably be $1\times10^8$Ω. The charging roller other than the downstream-side charging roller may desirably have the upper limit of the resistance value of $1\times10^9$Ω.

In Embodiment 5, the resistance value of the upstream-side charging roller 2 is made higher than that of the downstream-side charging roller 9 from the initial shipment state, so that the electric discharge current passing through the charging roller 2 at the initial shipment state is smaller than that passing through the charging roller 9. Further, as described in Embodiment 1, due to the difference in resistance value increasing speed, the resistance value of the charging roller 2 at the end of the lifetime is higher than the resistance value of the charging roller 9. For this reason, from the initial shipment state to the end of the lifetime, the resistance value of the charging roller 2 is higher than that of the charging roller 9, so that the electric discharge current passing through the charging roller 2 when the same oscillating voltage is applied is smaller than that passing through the charging roller 9.

That is, when the resistance value of the first charging member 2 is A1 (Ω) and the resistance value of the second charging member 9 is A2 (Ω), the resistance values A1 and A2 satisfy the following relationships.

$A2 \leq A1$ $1\times10^4\Omega \leq A1 \leq 1\times10^9\Omega$ $1\times10^4\Omega \leq A2 \leq 1\times10^8\Omega$ As described above, in this embodiment, the resistance value of the upstream-side charging roller at the initial shipment state was set at a value higher than that of the downstream-side charging roller, so that the excessive electric discharge did not occur on the upstream-side charging roller and the image flow and the drum abrasion were reduced.

<Embodiment 6>

(1) The period of the non-image formation in which the AC voltage of the oscillating voltage is set is not limited to the preparatory rotation operation period for the printing as described in Embodiment 1. The execution of the computing and determining program of proper peak-to-peak voltage value of the applied AC voltage or the AC current value in the charging step in the printing process can be effected with timing other than the preparatory rotation operation period for the printing. The execution of the program may also be effected in other periods of the non-image formation, i.e., during the initial rotation operation, during the sheet interval step and during post-rotation step. The execution of the program may also be effected every predetermined number of sheets subjected to image formation after being performed in the preparatory rotation operation period for the printing or may be effected during the non-image formation in which the continuous image formation is interrupted when the ambient temperature and humidity are changed. Further, in the case where the program execution is effected with an increased sheet interval during the continuous image formation, the program may also be executed in a dispersion manner during the non-image formation including a plurality of sheet intervals.

(2) The image bearing member may also be a direct charge injection type in which a charge injection layer having the surface resistance of $1\times10^9$-$1\times10^{14}$ Ω·cm is provided. Even in the case where the charge injection layer is not provided, a similar effect can be obtained when the charge transporting layer has the surface resistance in the above range. The image bearing member may also be an amorphous silicon photosensitive member having the surface layer volume resistivity of about $1\times10^{13}$ Ω·cm.

(3) The flexible contact charging member may include, in addition to the charging roller, those of fur brush, felt, cloth and the like. It is also possible to obtain the charging member having proper elasticity, electroconductivity, surface property, durability by combinations of various materials.

(4) The AC voltage waveform of the oscillating voltage applied to the contact charging member or the developing sleeve is not limited to the sine wave but may also be rectangular wave, triangular wave and the like. It is also possible to use a rectangular wave formed by periodically turning on and off the DC voltage.

(5) The exposure device is not limited to that for the laser beam scanning exposure. For example, the exposure device may also be digital exposure means using a solid light-emitting element array such as an LED array or an analog exposure means using a halogen lamp, a fluorescent lamp or the like as an original illuminating light source. In summary, the exposure device may only be required that the electrostatic image corresponding to the image information can be formed.

(5) The image bearing member may also be an electrostatic recording dielectric member. In this case, the surface of the dielectric member is uniformly charged and then the charged surface is charge-removed selectively by a charge-removing means such as a charge-removing needle head or an electron gun to form (write) the electrostatic latent image corresponding to objective image information.

(6) The developing means and method of the electrostatic image may be any means and method. The developing method may be a reverse developing method or a normal developing method. Generally, the developing method of the electrostatic image is roughly classified into four types consisting of a one-component noncontact developing method, a one-component contact developing method, a two-component non-contact developing method and a two-component contact developing method. In the one-component non-contact developing method, the electrostatic latent image is developed on the image bearing member in a non-contact state. In the one-component contact developing method, the electrostatic latent image is developed on the image bearing member with the toner coated on the image bearing member in a contact state. In the two-component contact developing method, the electrostatic image is developed on the image bearing member with a two-component developer, containing the toner and the carrier, which is carried on a developer-carrying member and is applied in the contact state. In the two-component non-contact developing method, the electrostatic image is developed on the image bearing member with the two-component developer in the non-contact state.

(7) The transfer means is not limited to the transfer roller but may also be a transfer blade, a transfer belt or those of a contact transfer charging type and a non-contact transfer charging type.

(8) The present invention is applicable to not only the monochromatic image forming apparatus but also an image forming apparatus for forming a multi-color or full-color image through multiple-transfer by using an intermediary transfer member such as a transfer drum or a transfer belt.

(9) The image forming process devices including the image bearing member may be assembled into a process cartridge which is detachably mountable to a main assembly of the image forming apparatus. The process cartridge may be prepared by integrally assembling the charging means and the developing means or the cleaning means with the image bearing member into a cartridge, which is detachably mountable to the main assembly of the image forming apparatus. It is also possible to assemble at least one of the charging means, the developing means and the cleaning means with the photosensitive drum into a cartridge. The developing means and the photosensitive drum may also be assembled into a cartridge.

(10) The charging member is not necessary be contacted to the surface of the image bearing member which is a member to be charged. The charging member may also be disposed in non-contact with (in proximity to) the image bearing member with a gap of several tens of microns so long as a dischargeable area determined by a gap voltage and a correction Paschen curve is ensured between the charging member and the image bearing member (proximity charging). In the present invention, this proximity charging also falls under the category of the contact charging.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 176251/2010 filed Aug. 5, 2010, which is hereby incorporated by reference.

What is claimed is:

1. An image forming apparatus, comprising:

a rotatable image bearing member;

a first charging roller for electrically charging said image bearing member by contacting said image bearing member to generate electric discharge between said first charging roller and said image bearing member;

a second charging roller for electrically charging said image bearing member, charged by said first charging roller, by contacting said image bearing member;

a toner image forming portion, provided downstream of said second charging roller and upstream of said first charging roller with respect to a rotational direction of said image bearing member, for forming a toner image on said image bearing member charged by said second charging roller;

a power source for applying, to said first and second charging rollers, a charging voltage in the form of a DC voltage biased with an AC voltage common to said first and second charging rollers;

a detecting portion for detecting an AC current passing through said second charging roller; and a setting portion for setting, on the basis of the AC current detected by said detecting portion when an AC voltage is applied to said second charging roller, a value of a peak-to-peak voltage of the AC voltage of the charging voltage.

2. An apparatus according to claim 1, wherein said setting portion calculates, on the basis of the AC current detected by said detecting portion when the AC voltage is applied to said second charging roller, a discharge current passing between said second charging roller and said image bearing member, and then sets the value of the peak-to-peak voltage on the basis of the discharge current.

3. An apparatus according to claim 2, wherein when a voltage at which the electric discharge is started between said second charging roller and said image bearing member under application of a DC voltage to said second charging roller is a discharge start voltage, said setting portion obtains the discharge current on the basis of the of AC current detected by said detecting portion when an AC voltage including a peak-to-peak voltage which is less than two times the discharge voltage is applied to said second charging roller and on the basis of the AC current detected by said detecting portion when an AC including a peak-to-peak voltage which is not less than two times the discharge voltage is applied to said second charging roller.

* * * * *